US009172140B2

(12) United States Patent
Crouch et al.

(10) Patent No.: US 9,172,140 B2
(45) Date of Patent: Oct. 27, 2015

(54) MULTIPLE INPUT LOOP ANTENNA

(71) Applicant: Raytheon Company, Waltham, MA (US)

(72) Inventors: David D. Crouch, Corona, CA (US); Keith G. Kato, Alta Loma, CA (US)

(73) Assignee: Raytheon Company, Waltham, MA (US)

( * ) Notice: Subject to any disclaimer, the term of this patent is extended or adjusted under 35 U.S.C. 154(b) by 269 days.

(21) Appl. No.: 13/721,897

(22) Filed: Dec. 20, 2012

(65) Prior Publication Data

US 2014/0176373 A1 Jun. 26, 2014

(51) Int. Cl.

| | |
|---|---|
| ***H01Q 7/00*** | (2006.01) |
| ***H01Q 13/00*** | (2006.01) |
| ***H01Q 21/00*** | (2006.01) |
| ***H01Q 3/26*** | (2006.01) |
| ***H01Q 9/42*** | (2006.01) |
| ***H01Q 21/24*** | (2006.01) |
| ***H01Q 21/28*** | (2006.01) |
| ***H01Q 5/35*** | (2015.01) |

(52) U.S. Cl.

CPC ..... *H01Q 7/00* (2013.01); *H01Q 3/2605* (2013.01); *H01Q 5/35* (2015.01); *H01Q 9/42* (2013.01); *H01Q 13/00* (2013.01); *H01Q 21/0006* (2013.01); *H01Q 21/24* (2013.01); *H01Q 21/28* (2013.01)

(58) Field of Classification Search

CPC ..... H01Q 5/35; H01Q 7/00; H01Q 3/2605; H01Q 21/0006; H01Q 21/24; H01Q 21/28

USPC ..... 343/744, 867, 850, 853, 855

See application file for complete search history.

(56) References Cited

U.S. PATENT DOCUMENTS

| | | | | |
|---|---|---|---|---|
| 5,654,724 | A | 8/1997 | Chu | |
| 6,653,982 | B2 * | 11/2003 | Lindenmeier et al. | 343/741 |
| 7,292,195 | B2 * | 11/2007 | Phillips et al. | 343/744 |

(Continued)

FOREIGN PATENT DOCUMENTS

| | | | | |
|---|---|---|---|---|
| EP | 0 501 169 | A1 | 9/1992 | |
| EP | 1 289 057 | A1 | 3/2003 | |
| JP | 6-140801 | * | 5/1994 | H01P 1/10 |

OTHER PUBLICATIONS

Wang, et al.; "Analysis of Concatenated Waveforms and Required STC;" Radar Conference 08; IEEE; May 26-30, 2008; pp. 1-6.

Invitation to Pay Additional Fees of the ISA for PCT/US2013/040035 dated Dec. 11, 2013.

PCT Search Report of the ISA for PCT/US2013/040035 dated Jun. 16, 2014.

(Continued)

*Primary Examiner* — Hoang V Nguyen

(74) *Attorney, Agent, or Firm* — Daly, Crowley, Mofford & Durkee, LLP

(57) ABSTRACT

A multiple input loop antenna comprising one or more half-loop antennas disposed above a ground plane wherein the plane of each half loop is perpendicular to the ground plane such that the multiple input loop antenna is a three-dimensional structure and electromagnetic waves are radiated from points within the volume occupied by the antenna rather than from a two-dimensional surface. For this reason, the multiple input loop antenna can radiate levels of peak power without inducing excessive air breakdown which are relatively high compared with peak power levels of conventional antennas having comparable transverse dimensions. Also described is an array antenna comprised of an array of multiple input loop antennas.

23 Claims, 27 Drawing Sheets

(56) References Cited

U.S. PATENT DOCUMENTS

| | | | | |
|---|---|---|---|---|
| 8,350,776 | B1 * | 1/2013 | Bauman | 343/855 |
| 2002/0118138 | A1 | 8/2002 | Lindenmeier et al. | |

OTHER PUBLICATIONS

PCT Written Opinion of the ISA for PCT/US2013/040035 dated Jun. 16, 2014.

* cited by examiner

FIG. 1
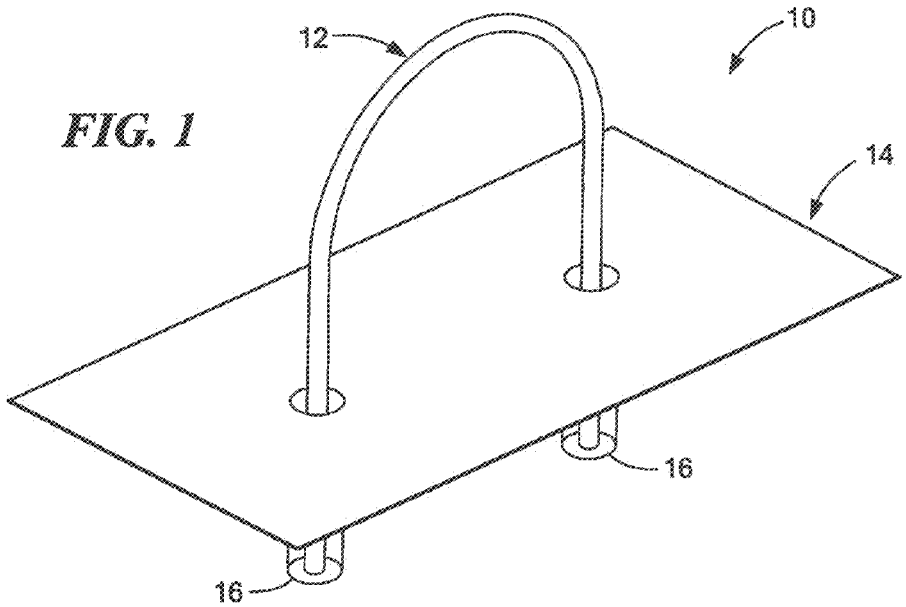
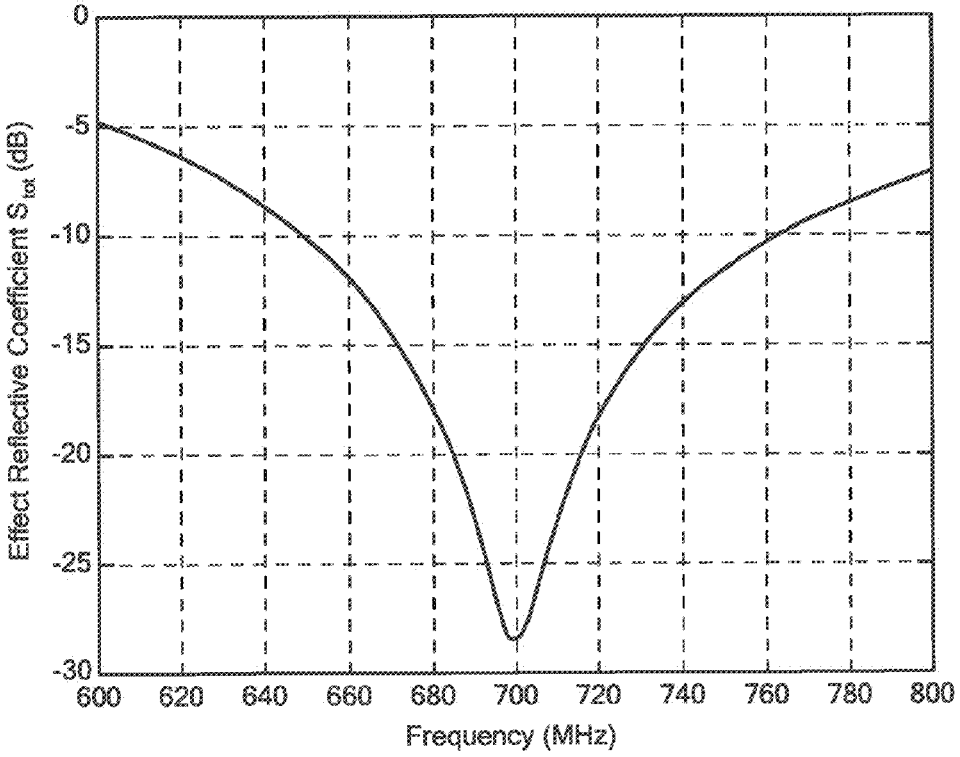
FIG. 2

Calculated Circularly-Polarized Radiation Patterns for Four-Port Antenna

Peak Directivity = 2.9357

Calculated Circularly-Polarized Radiation Patterns for Four-Port Antenna

Peak Directivity = 1.8181

Calculated Circularly-Polarized Radiation Patterns for Four-Port Antenna

Peak Directivity = 2.4026

Calculated Linearly-Polarized Radiation Patterns for Four-Port Antenna

Peak Directivity = 5.2482

Calculated Linearly-Polarized Radiation Patterns for Four-Port Antenna

Peak Directivity = 1.4447

Calculated Linearly-Polarized Radiation Patterns for Four-Port Antenna

Peak Directivity = 5.2482

Four-Input Array Element

Top View

Side View

Peak Directivity = 311.86

Peak Directivity = $4.6079 \times 10^{-3}$

Peak Directivity = 311.85

Peak Directivity = $4.5891 \times 10^{-3}$

Peak Directivity = 311.85

Top View

Side View

MULTIPLE INPUT LOOP ANTENNA

FIELD OF THE INVENTION

The concepts, systems and techniques described herein relate to phased array antennas and more particularly to phased array antenna elements that coherently combine the outputs of multiple RF sources and radiate very high peak power levels without initiating air breakdown at the array aperture.

BACKGROUND OF THE INVENTION

As is known in the art, antenna elements (or more simply "elements") constituting a phased array antenna have used electric dipoles, for example half-wave dipoles, or coupling slots to transfer energy from a travelling wave within a waveguide mode into the slot and, thereafter, to free space. A topologically deformed version of the half-wave dipole is a patch antenna element having a thin circular plate standing off one-quarter-wavelength (including intervening dielectric materials) from a reflecting plate. The circular plate can be energized by providing radio frequency (RF) signals to multiple input ports. The phase relationship between the ports determines whether a linearly polarized, elliptically polarized, or circularly polarized electromagnetic signal or wave is launched from the plate.

The patch antenna element has a low dimensional profile, but the thinness of the circular plate has a limiting electric field due to edge enhancement effects, even if contoured Rogowski surfaces are used.

Slotted arrays using waveguide must cope with the physical dimensions of the waveguide itself. Since the entire generated power must exist in the waveguide at some point, the waveguide must be insulated (e.g. by creating a vacuum in the waveguide) to prevent breakdown of the extremely high waveguide fields (i.e., high power) within the waveguide. Thus vacuum pumps must be included as part of the system design.

Hence, a need exists for an antenna element that coherently combines the RF outputs from multiple sources and radiates at high peak power levels without inducing air breakdown at an antenna aperture.

SUMMARY OF THE INVENTION

The concepts, systems and techniques described herein find application in high power microwave (HPM) directed energy system architectures for which HPM is generated locally at multiple nodes, but with frequency and phase control characteristics to allow the total power so generated to be combined in free space rather than within a smaller structure such as a waveguide or resonant cavity. While this architecture appears similar to a standard phased array antenna, the power generated at each node can be several tens of megawatts, thus producing a total power-aperture product for the HPM system to be at the gigawatt level—much higher than a standard phased array.

One advantage of a system utilizing the concepts described herein is the resultant higher power handling capability per node, as opposed to similar architectures using an electric field "patch" antenna element. Another advantage of a system utilizing the concepts described herein is the reduction of the unit of manufacture to a single quasi-"tile" which can then be emplaced in a field pattern of many tiles. Yet another advantage of a system utilizing the concepts described herein is the elimination of vacuum structures used to prevent breakdown from HPM-level electric fields.

The concepts, systems, and techniques described herein illustrate a particularly simple scheme to use emerging waveform-generating technology to launch electromagnetic wave energy directly off an antenna aperture surface. The most common method of launching electromagnetic energy into a structure such as a cavity, waveguide, or antenna element, is to use electric field coupling.

The concepts, systems and techniques described herein, however, use magnetic rather than electric field coupling. This approach allows the construction of a relatively simple, and modular, launching structure. Such a launching structure has an intrinsic power-handling capability which is relatively high compared to launching structures used with electric field-coupled schemes. This is because magnetic coupling utilizes current loops which do not rely on small, high-field gaps as do most electric-field coupling structures.

In accordance with the concepts described herein, a multiple input loop antenna comprises one or more half-loop antennas disposed above a ground plane. The plane of each half loop is perpendicular to the ground plane. In one exemplary embodiment, coaxial transmission lines feed both ends of each loop in a push-pull configuration, i.e., the input signals feeding opposite ends of each loop are of approximately equal amplitudes and are 180° out of phase. It should be appreciated that while embodiments described herein use 180 degree phasing and equal amplitude input signals it is possible to design a multiloop antenna in which opposite inputs have phase differences other than 180 degrees. Also, one example in which equal amplitude would not be used is in an N>4 linearly polarized antenna wherein half-loops are connected at a common point where the loops converge.

In accordance with a further aspect of the concepts, systems and techniques described herein, a four-input antenna comprising two loops can be used to combine the outputs from four separate radio frequency (RF) sources, and can radiate either linear or circular polarization, depending upon the relative phases of the signals driving each loop. The radiated polarization can be changed dynamically by appropriately shifting the phases of the input signals. The reflected power at each input contains a direct contribution due to the discontinuity at the feed point, and a contribution due to cross-coupling from other inputs. By properly configuring the antenna geometry, the direct and cross-coupled contributions to the reflected signal can be made to cancel. It should be appreciated that regardless of the number of inputs, by adjusting selected geometric parameters it is possible to force the reflections to partially cancel at the desired operating frequency or over a desired frequency range. A person of ordinary skill in the art will understand which geometric parameters to choose and will be capable of optimizing the antenna geometry via simulation with any of a number of commercial EM simulation tools.

Unlike most other array elements, the multiple input loop antenna is a three-dimensional structure and electromagnetic waves are radiated from points on the surface of the volume occupied by the antenna rather than from a flat two-dimensional surface. Electromagnetic energy enters the antenna via multiple inputs, avoiding the high concentration of energy that is realized with only a single input. The radiating structure itself avoids sharp edges that can cause air breakdown via edge enhancement. For these reasons, the multiple input loop antenna can radiate levels of peak power without inducing excessive air breakdown which are higher than levels radiated by conventional antennas having comparable transverse dimensions.

With this particular arrangement, a multiple input loop antenna having high power handling capability, polarization agility, modular unit of manufacture, ability to create an aperture field of arbitrary size and graceful degradation of performance with the loss of a single element is provided. Furthermore, each multiple input loop antenna can be used as an element in an array. Using a plurality of multiple input loop antennas in an array allows quick replacement of a damaged single element.

BRIEF DESCRIPTION OF THE DRAWINGS

FIG. 1 is a perspective view of a two-input loop antenna designed for stand-alone operation.

FIG. 2 is a plot of calculated effective reflection coefficient at each of the two inputs of the two-input loop antenna shown in FIG. 1.

FIG. 5*a* is a view of the upper side showing the antenna and the top of the finite ground plane.

FIG. 5*b* is a view of the lower side showing the RF connectors attached to the bottom of the finite ground plane.

DETAILED DESCRIPTION OF THE PREFERRED EMBODIMENTS

Figure 3:
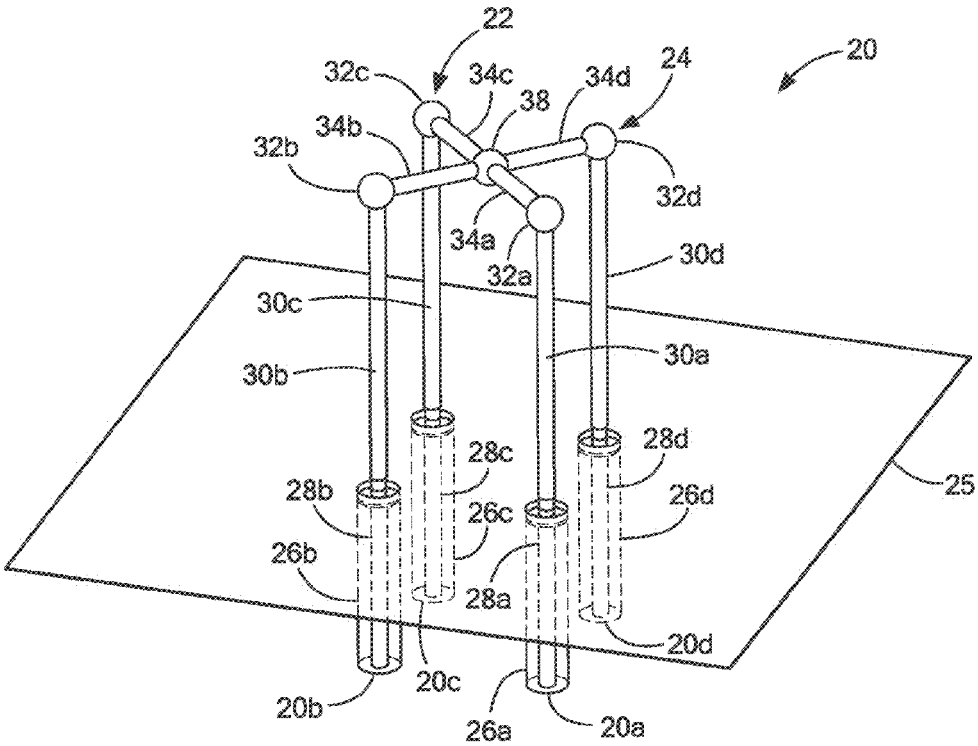
FIG. 3 is a perspective view of a four-input loop antenna designed for stand-alone operation.

Described herein is a multiple-input loop antenna which includes both power combining and radiation functions in a single integrated device. Multiple inputs each fed by a coaxial transmission line allow radio frequency (RF) power to be delivered to each input at a first (lower) power level, after which the radiating structure of the antenna combines the delivered power in free space to result in a second (higher) power level. This approach eliminates the need to combine the power within a confined space (in waveguide, for example) prior to delivery to the antenna.

Different embodiments of the multiple input loop antenna are responsive to (e.g. can transmit or receive) linearly-polarized RF signals or circularly-polarized RF signals. In one embodiment, a rotationally-symmetric four-port antenna can radiate or receive signals having either of two orthogonal linear polarizations or either left- or right-handed circular polarization. All that is required is that the relative phases of the inputs be set appropriately to receive a desired polarization.

Polarization diversity, i.e., the ability to switch from being responsive to a first polarization to a second different polarization, is realized by implementing phase control over the input signals. That is, by adjusting the phases, the antenna can switch from being responsive to signals having left-handed circular polarization to signals having vertical linear polarization, for example. When extended to more than four ports, rotationally-symmetric multi-port antennas can radiate either left- or right-handed circular polarization with only phase control over the input signals. To radiate linear polarization also requires amplitude control and a reduction in total radiated power. In some cases, one or more of the input signal amplitudes must be set to zero.

Turning now to FIG. 1, a two-input loop antenna 10 includes a single loop 12 disposed over a first surface of a ground plane 14. This structure forms a building block which can be used to provide an array antenna.

The two ends of the loop terminate at the ground plane where each forms an interface with a coaxial transmission line 16 that delivers RF power through openings in ground plane 14 to each end of the loop. The RF fields at each end of the loop have substantially equal amplitudes and a phase difference of 180°. Because coupling between the two inputs is unavoidable, it is essential that it be taken into account in matching the input impedances of the two inputs.

The two-input loop shown in FIG. 1 is a two-port device with an S-matrix of the form:

$$\begin{bmatrix} B_1 \\ B_2 \end{bmatrix} = \begin{bmatrix} S_{11} & S_{12} \\ S_{21} & S_{22} \end{bmatrix} \begin{bmatrix} A_1 \\ A_2 \end{bmatrix}. \quad \text{Eq. (1)}$$

Symmetry dictates that $S_{11}=S_{22}$ and $S_{12}=S_{21}$. Under ideal conditions, the amplitudes of the RF excitations (represented by $A_1$ and $A_2$) at the two inputs are equal, and their phases differ by 180°. That is, $$A_1=A, \quad \text{Eq. (2)}$$

$$A_2=-A. \quad \text{Eq. (3)}$$

Under these conditions, the amplitudes of the reflected waves at the two inputs (represented by $B_1$ and $B_2$) are $$B_1=(S_{11}-S_{12})A=S_{tot}A, \quad \text{Eq. (4)}$$

$$B_2=(S_{12}-S_{11})A=-S_{tot}A, \quad \text{Eq. (5)}$$

where $S_{tot}$ ($-S_{tot}$) is the effective reflection coefficient at input port 1 (input port 2). If $S_{11}=S_{12}$, then both input ports are matched, and none of the incident power is reflected by the antenna.

In the exemplary embodiment shown in FIG. 1, the geometry of the antenna itself is used to satisfy Eq. (5) at the desired frequency of operation of 700 MHz ($\lambda$=16.87 inches). The antenna comprises one-half of a circular loop sitting atop two vertical posts 16. In the present example, the height of the vertical posts and their horizontal separation are adjusted to match the input impedance at each of the two antenna input ports. When optimized to minimize reflected power at a frequency of 700 MHz, the input ports are separated by 7.699 inches, and the vertical posts are 3.267 inches in length.

FIG. 2 shows the calculated reflection coefficient at each of the two input ports as a function of frequency for the antenna in FIG. 1. The return loss (the negative of the reflection coefficient plotted in FIG. 1) exceeds 10 dB over a span of frequencies from 650 to 762 MHz, a bandwidth exceeding 10%.

Figure 4A:
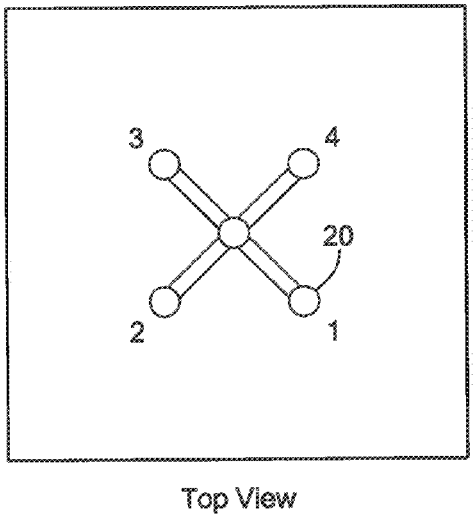
FIGS. 4A and 4B are respective top and side views of the four-input loop antenna shown in FIG. 3.
Figure 4B:
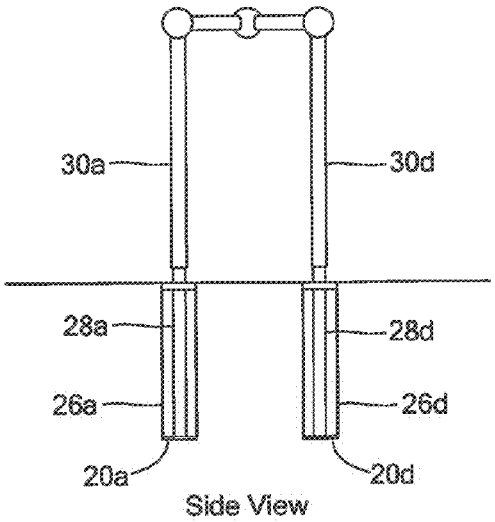

Referring now to FIGS. 3, 4A, 4B, a two-loop antenna 20 has four inputs 20*a*, 20*b*, 20*c*, 20*d* (i.e. a four input loop antenna). The radiation pattern and the power-handling capability of the antenna can be enhanced by placing multiple loops 22, 24 in parallel over a ground plane 25.

In the exemplary antenna embodiment of FIGS. 3, 4A and 4B, the four input ports 20*a*-20*d* are provided from coaxial feed lines 26*a*-26*d*. The feed lines lie on a circle of radius 2.536 inches. The center conductor 28*a*-28*d* of each of the respective coaxial feed lines is rigidly attached to a respective one of vertical posts 30*a*-30*d*, with each of the posts having a diameter of 0.375 inches and length 6.791 inches. Each of the four vertical posts is capped by a respective one of four spherical balls 32*a*-32*d* each of the balls having a diameter of 0.75 inches. Also connected to each ball is a horizontal cylindrical rod 34*a*-34*d* having the same diameter as each vertical post. The horizontal rods 34*a*-34*d* extend towards the center of the circle on which the four input ports lie, and are joined in the center by a fifth spherical ball 38 of diameter 0.75 inches. The spherical balls 32*a*-32*d* and 38 serve as connectors between the vertical posts 30*a*-30*d* and the horizontal rods 32*a*-32*d*.

In operation, all four antenna ports 20*a*-20*d* are driven simultaneously, so it is not sufficient to match each port individually, as cross coupling between input ports will be present. This is reflected in the S matrix for this antenna, which is of the form $$\begin{bmatrix} B_1 \\ B_2 \\ B_3 \\ B_4 \end{bmatrix} = \begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} \begin{bmatrix} A_1 \\ A_2 \\ A_3 \\ A_4 \end{bmatrix}. \quad \text{Eq. (5)}$$

The enumeration of ports 20*a*-20*d* as port 1-4 for the purposes of Equation (1) is shown in FIG. 4(A). Here $A_1$-$A_4$ are the complex amplitudes of the RF signals at ports 1-4, respectively, and $B_1$-$B_4$ are the corresponding complex amplitudes of the reflected signals. Note that the wave reflected from each port comprises a directly reflected component and three cross-coupled components. Consider input port 1, for example. The complex amplitude of the reflected wave is $$B_1=S_{11}A_1+S_{12}A_2+S_{13}A_3+S_{14}A_4 \quad \text{Eq. (6)}$$

The directly reflected component depends on the diagonal element of the S matrix $S_{11}$, and is represented by the first term $S_{11}A_1$. The remaining three terms account for cross coupling between Port 1 and the remaining three ports. The four-port antenna illustrated in FIGS. 3 and 4 is symmetric with respect to 90 degree rotations about a vertical axis through the center of the antenna. That is, the antenna is geometrically invariant under rotations by integer multiples of 90 degrees about its axis of symmetry.

For this reason, all four ports are equivalent. The symmetry of the antenna makes it sufficient to minimize the total reflected power at one port only, since symmetry dictates that if one port is matched, then all four ports will be matched.

The total complex effective reflection coefficient at port 1 is $$S_{1eff} = \frac{S_{11}A_1 + S_{12}A_2 + S_{13}A_3 + S_{14}A_4}{|A_1|}. \quad \text{Eq. (7)}$$

If it is desired to radiate linear polarization, then $A_1=A_2=A$ and $A_3=A_4=-A$, so that $$S_{1eff}^{lin}=S_{11}-S_{13}+S_{12}-S_{14}. \quad \text{Eq. (8)}$$

By symmetry, $S_{12}=S_{14}$, so that $S_{1eff}^{lin}=0$ if $S_{11}=S_{13}$. In this case, fields coupled from port 2 to port 1 are cancelled by fields coupled from port 4 to port 1. When the antenna geometry is such that $S_{11}=S_{13}$, fields directly reflected from port 1 are cancelled by fields coupled from port 3 to port 1, and all four ports are matched (by symmetry $S_{22}=S_{24}$, $S_{33}=S_{31}$, and $S_{44}=S_{42}$). One can also show that each port remains matched if the phases of the inputs are changed to yield a circularly-polarized radiated wave. For circular polarization $A_1=-A_3=A$ and $A_2=-A_4=A\exp(\pm j\pi/2)$, in which case $$S_{1eff}^{circ}=S_{11}-S_{13}\pm j(S_{12}-S_{14}). \quad \text{Eq. (9)}$$

Once again, we see that $S_{1eff}^{circ}=0$ if $S_{12}=S_{14}$ and $S_{11}=S_{13}$. The same antenna will radiate either linear or circular polarization when excitations having the proper phases are applied to its inputs.

Figure 5A:
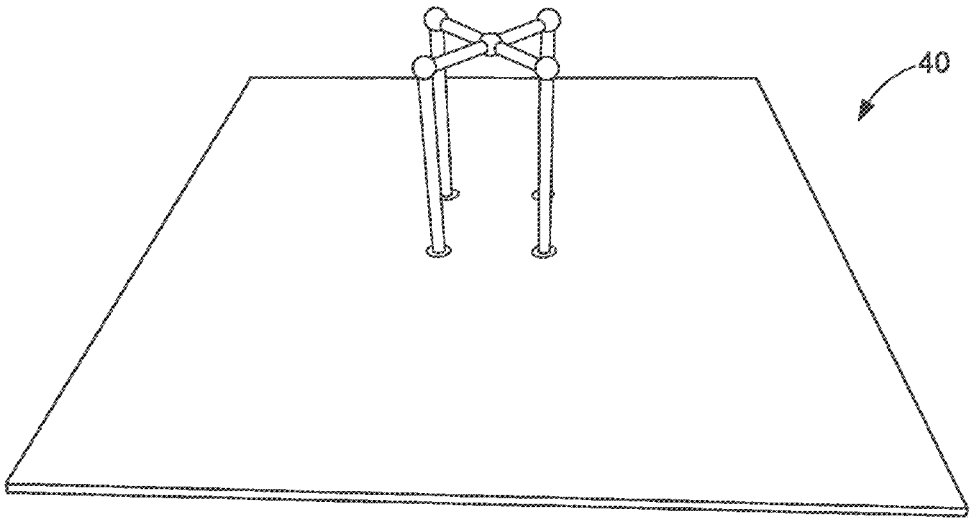
FIGS. 5A and 5B are respective perspective top and bottom views of a prototype four-input loop antenna of the same design as that shown in FIGS. 3 and 4.
Figure 5B:
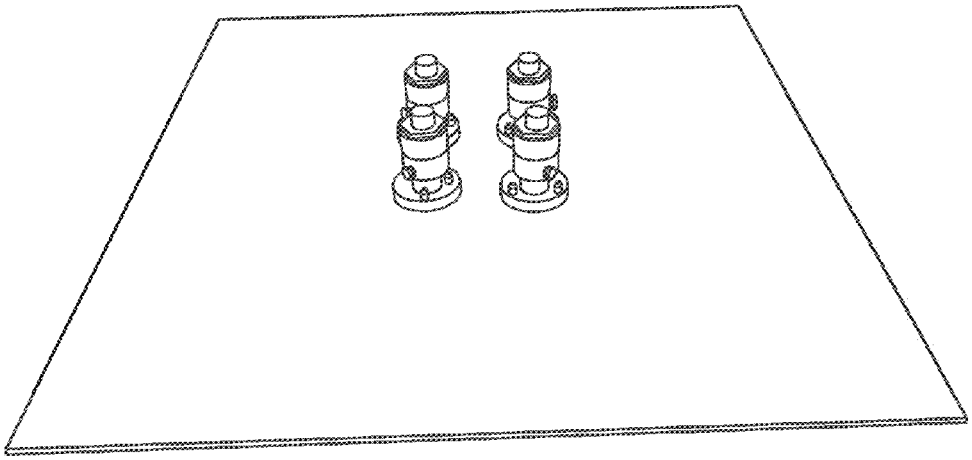

Referring now to FIG. 5, two views of a prototype four-input antenna of the same design as that illustrated in FIGS. 3 and 4. FIG. 5A shows the antenna and the top side of a finite 24" by 24" ground plane. FIG. 5B shows the RF connectors attached to the back side of the ground plane.

Figure 6A:
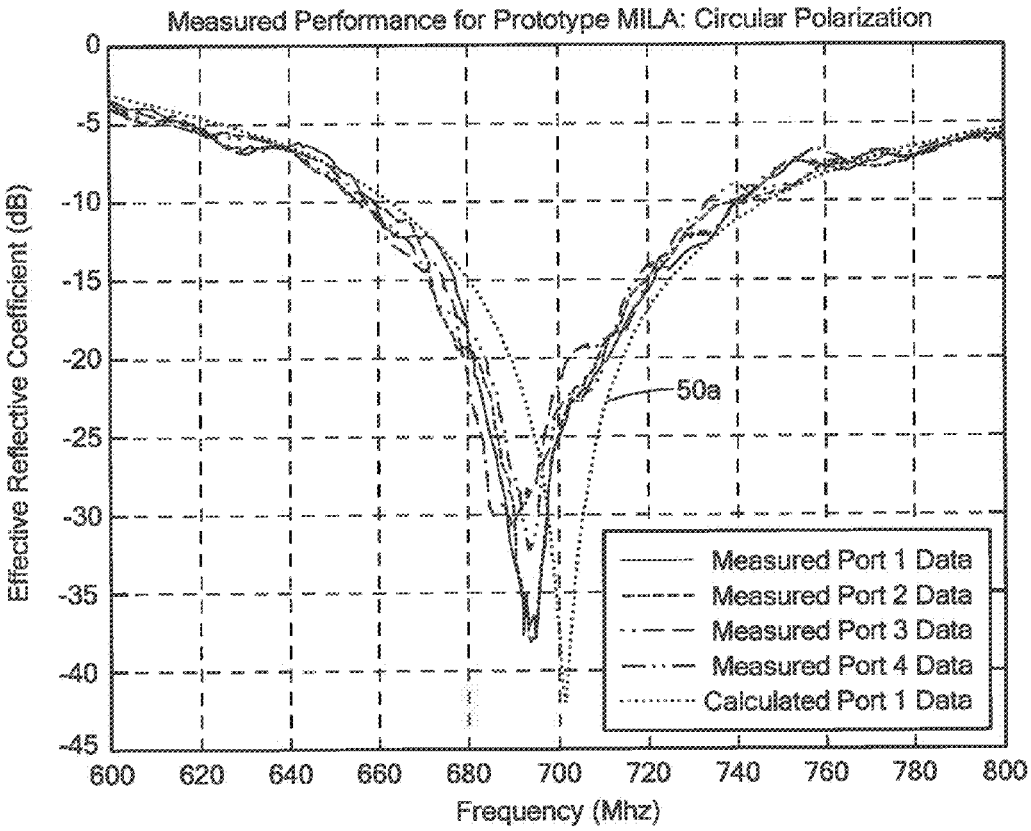
FIG. 6A is a plot of the measured and calculated effective reflection coefficients for each input as a function of frequency when the input phases are set to generate RHCP radiation.
Figure 6B:
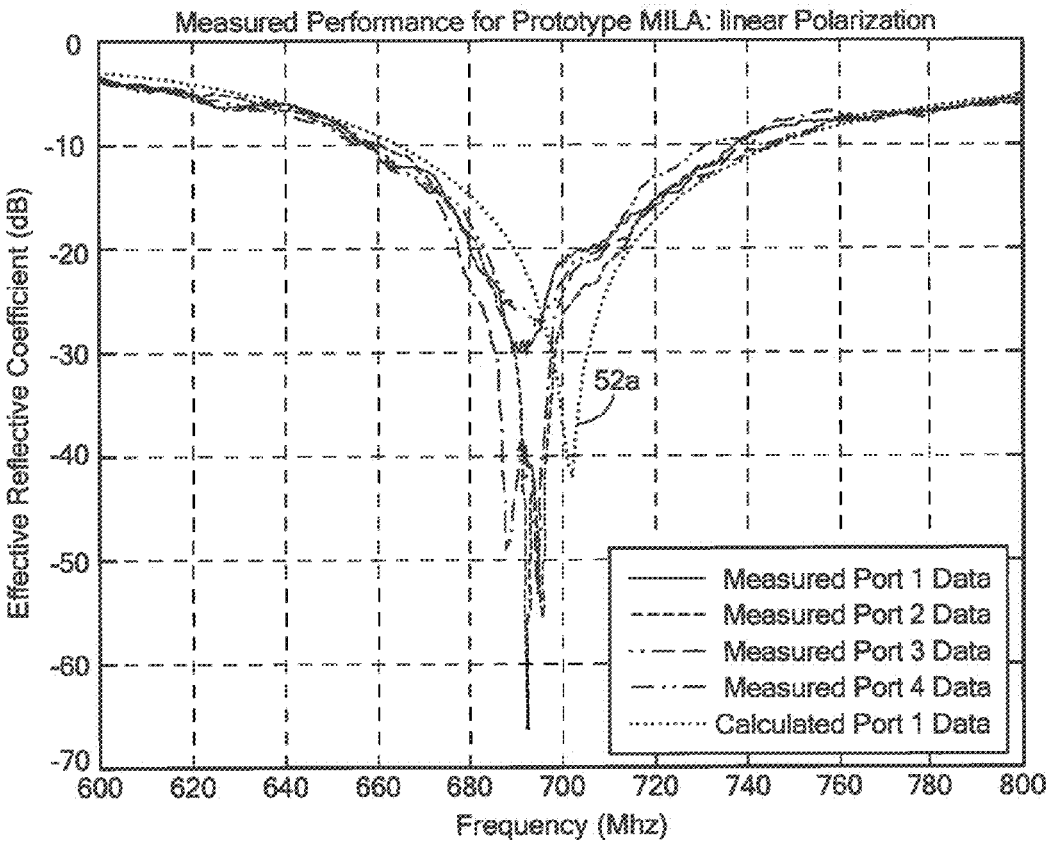
FIG. 6B is a plot of the measured and calculated effective reflection coefficients for each input as a function of frequency when the input phases are set to generate linear polarization.

A complete set of 16 S parameters were measured for the four-input prototype antenna from 600 MHz to 800 MHz and used to determine the effective reflection coefficients for all four inputs for both circularly and linearly polarization. Both measured and calculated effective reflection coefficients are plotted in FIG. 6A, 6B. The effective reflection coefficients when the input phases are set to generate RHCP are shown in FIG. 6A. The frequency at which the measured effective reflection coefficients reach a minimum deviates slightly from the calculated value; this is believed to be due to the effects of the finite ground plane (the simulation model used to design the antenna assumes an infinite ground plane). Otherwise, the agreement between the measured and calculated values is good. The measured bandwidth over which the effective reflection coefficients are less then −10 dB is approximately 80 MHz (11.4%), compared to a calculated value of 85 GHz (12%). The effective reflection coefficients when the input phases are set to generate linear polarization are shown in FIG. 6B, and again, agreement between measured and calculated data is good. FIGS. 6A and 6B further demonstrate that a single antenna can be made to radiate either circular or linear polarization merely by adjusting the input phases.

It should be noted that the measured effective reflection coefficients plotted in FIGS. 6A and 6B for circularly- and linearly-polarized radiation, respectively, are very similar, and would in fact be identical except for the effects of noise, measurement error, unintended asymmetries in the antenna introduced during fabrication, etc. The radiated patterns, however, will not be the same.

Figure 7A:
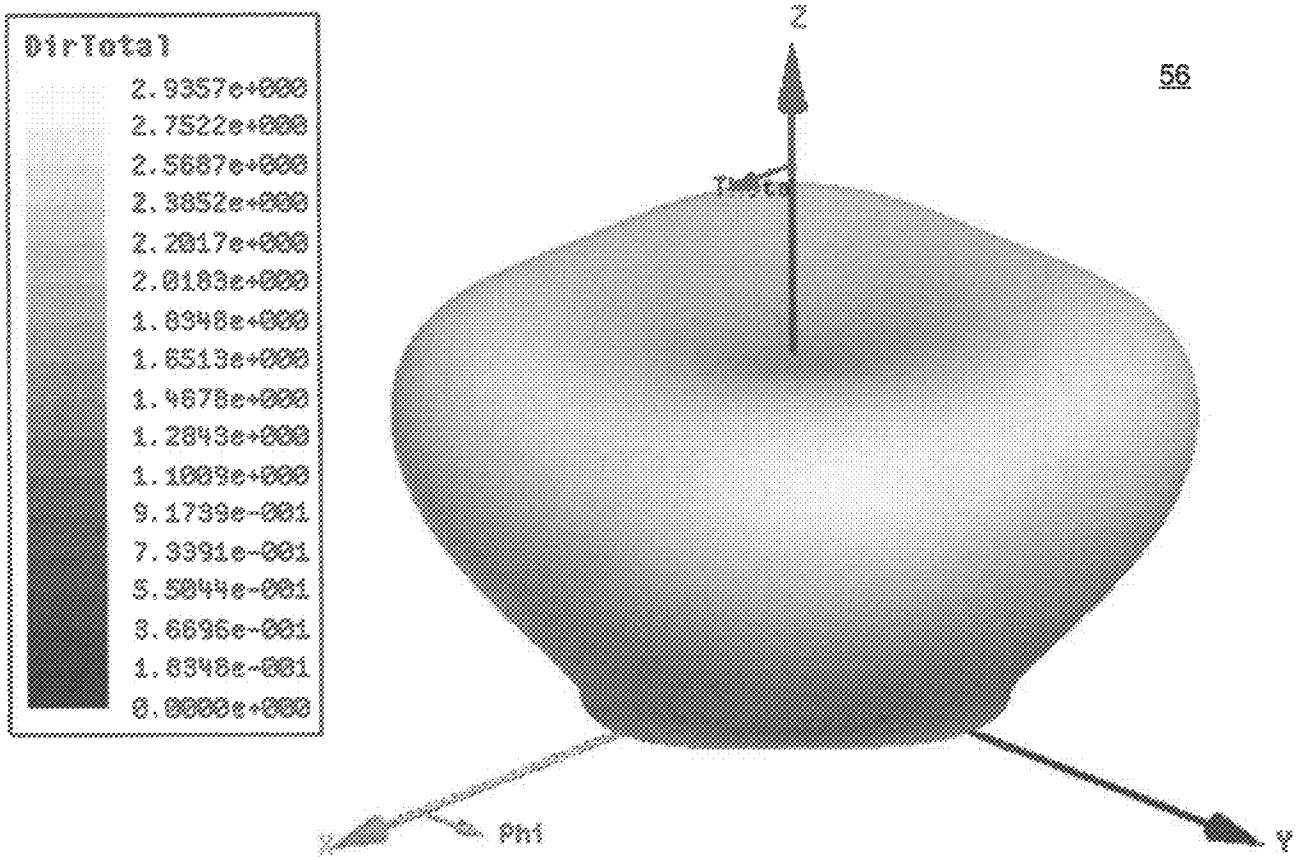
FIGS. 7A, 7B, 7C are calculated three-dimensional directivity patterns for the four-input loop antenna of FIGS. 3, 4, and 5 when the input phases are set to generate right-hand circularly-polarized radiation.
Figure 7B:
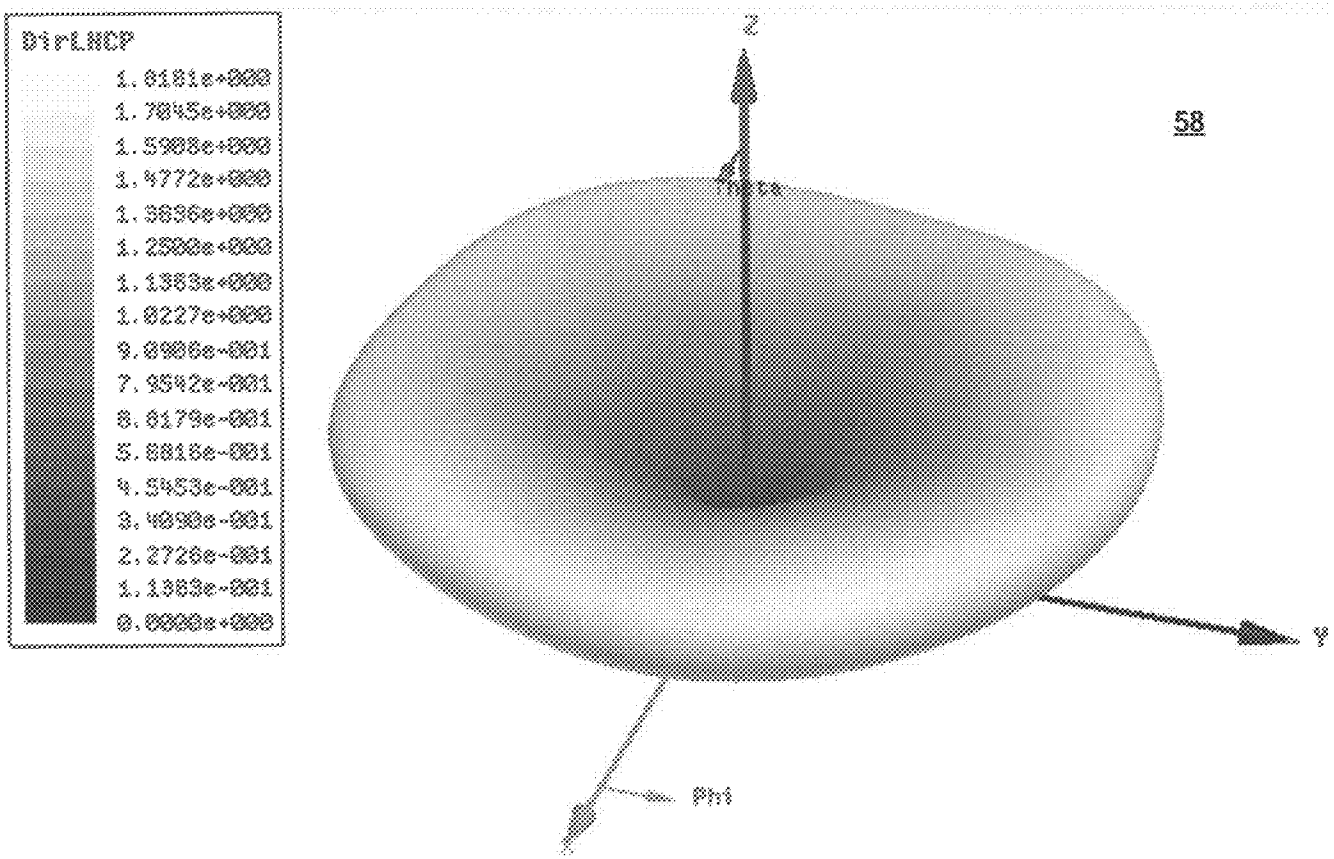
Figure 7C:
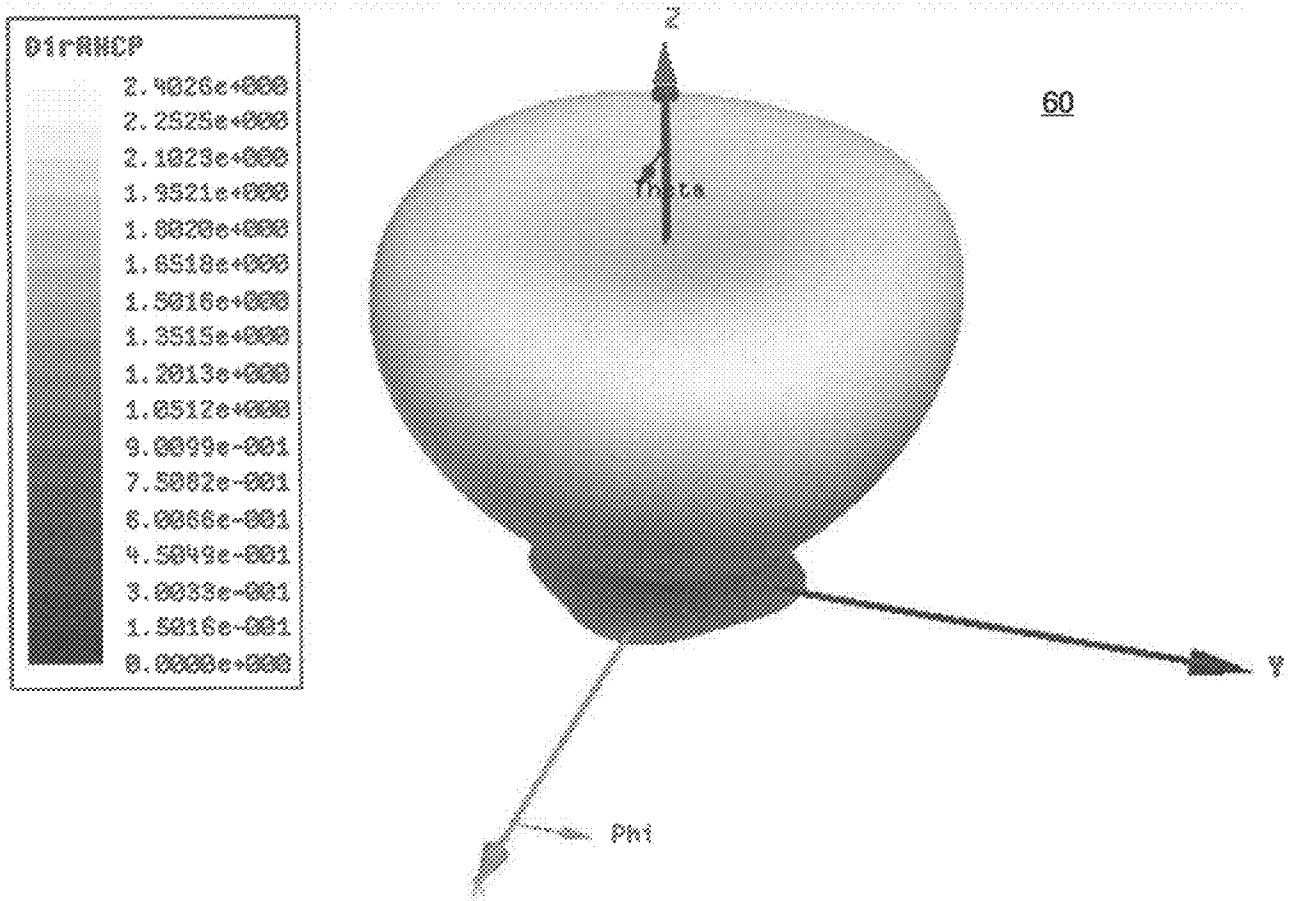

Referring now to FIGS. 7A-7C, calculated three-dimensional circularly-polarized directivity patterns for the stand-alone antenna illustrated in FIGS. 3 and 4 are shown. In this case, the inputs are phased to yield right-hand circular polarization (RHCP). The total directivity pattern is shown in FIG. 7A. FIGS. 7B and 7C show the patterns for left-hand circular polarization (LHCP), which in this case is the undesired cross-polarized component, and RHCP, which is the desired co-polarized component. A comparison of FIGS. 7A and 7C shows the directivity to be predominantly RHCP, but FIG. 7B also reveals a significant cross-polarized component.

Figure 8A:
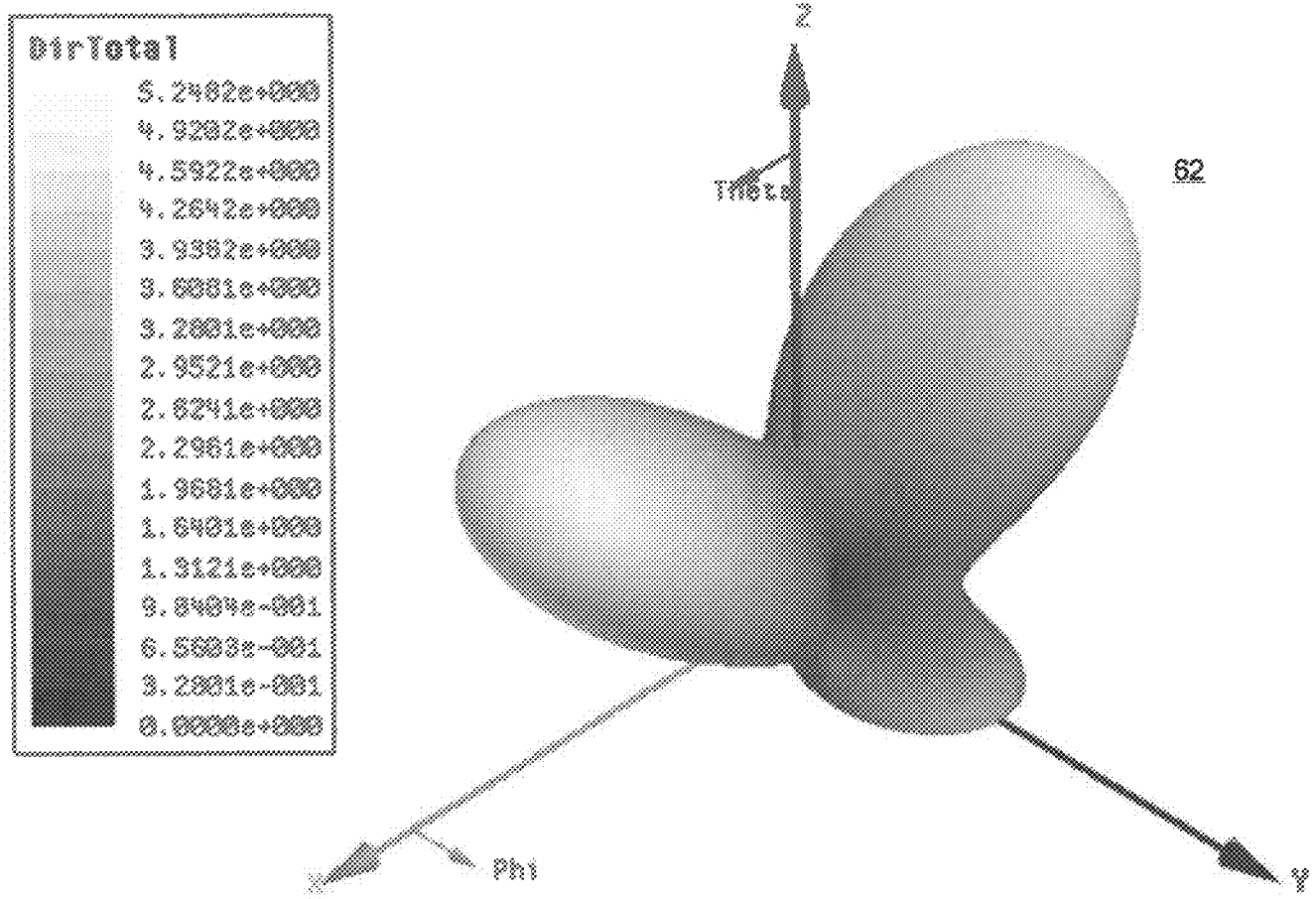
FIGS. 8A, 8B, 8C are calculated three-dimensional directivity patterns for the four-input loop antenna of FIGS. 3, 4, and 5 when the input phases are set to generate linear polarization parallel to the y-axis.
Figure 8B:
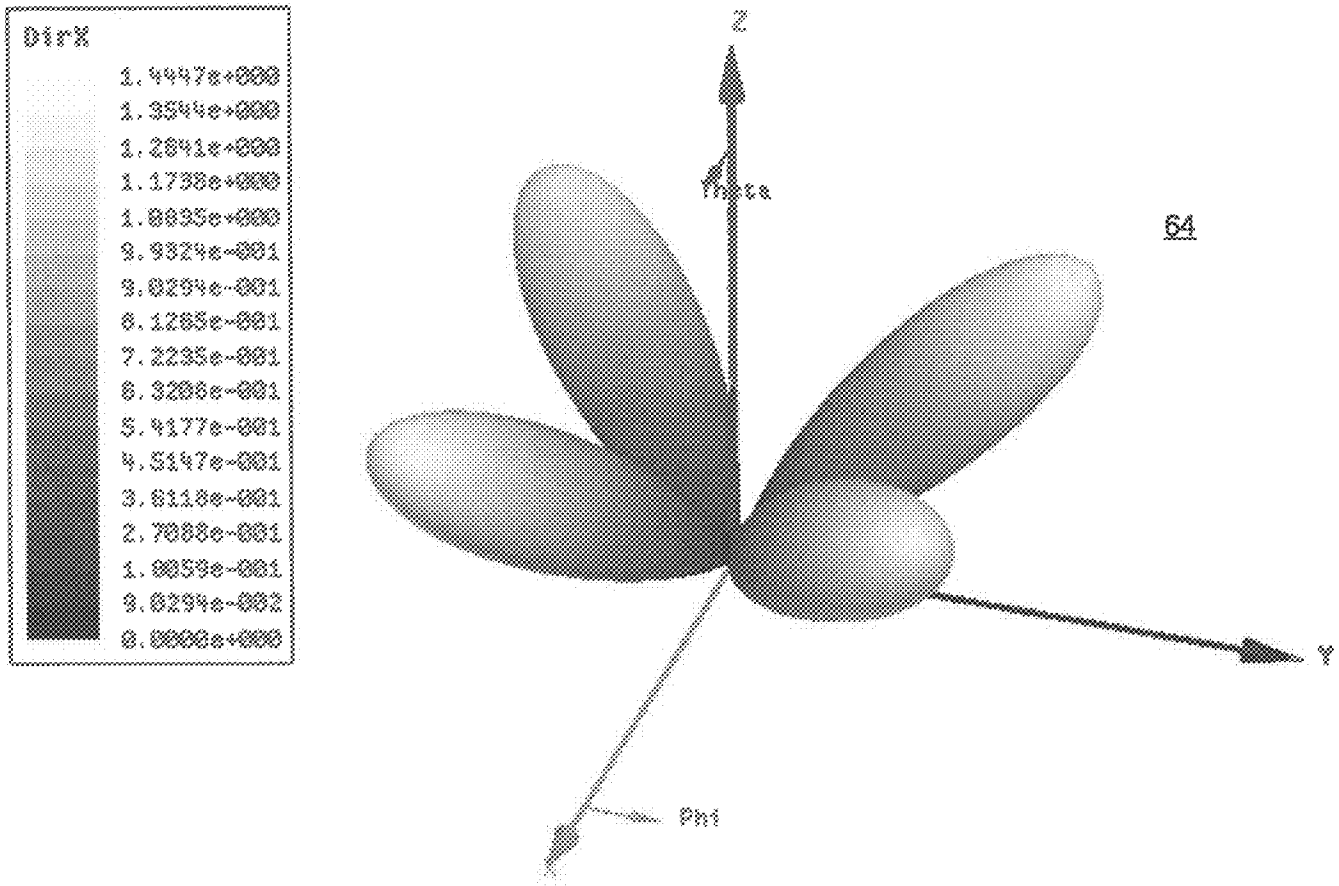
Figure 8C:
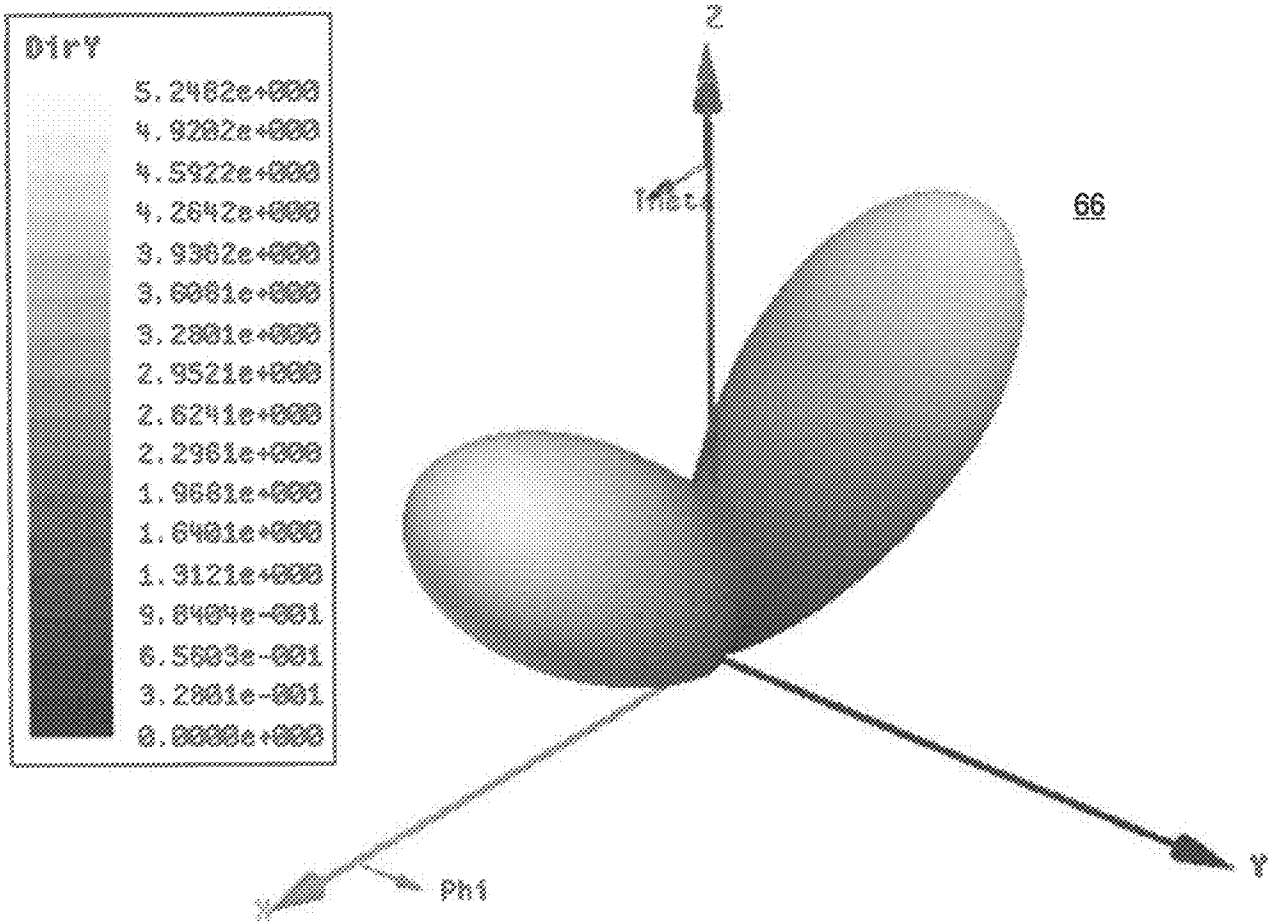

Referring now to FIG. 8, the corresponding linearly-polarized directivity patterns for the antenna shown in FIGS. 3 and 4 are shown. Here the radiation is predominantly y-polarized, but there is a significant x-polarized component as well. Furthermore, the desired y-polarized pattern has two significant off-axis lobes.

It should be appreciated that while the antenna shown in FIGS. 3 and 4 is an isolated antenna element backed by an infinite ground plane, the antenna also finds use as an antenna element in an array antenna.

Figure 9:
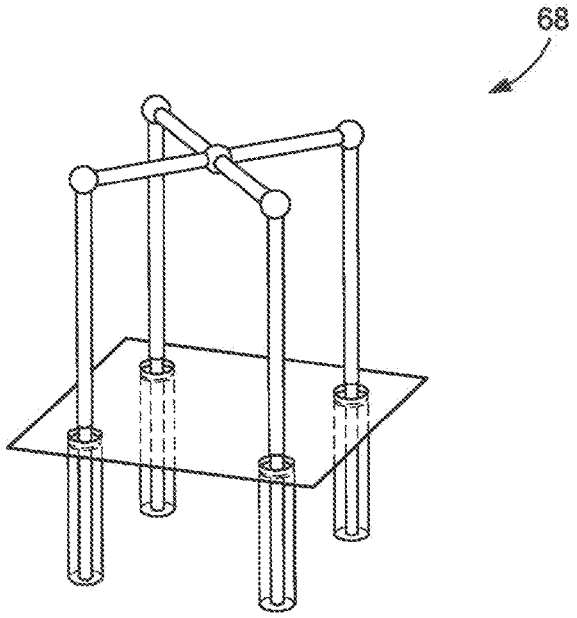
FIG. 9 is a perspective view of a four-input loop antenna designed specifically as a phased-array element.
Figure 10A:
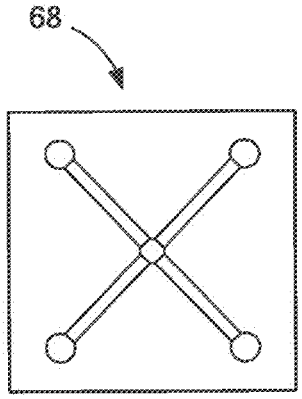
FIGS. 10A and 10B are top and side views, respectively, of the four-input array element shown in FIG. 9.
Figure 10B:
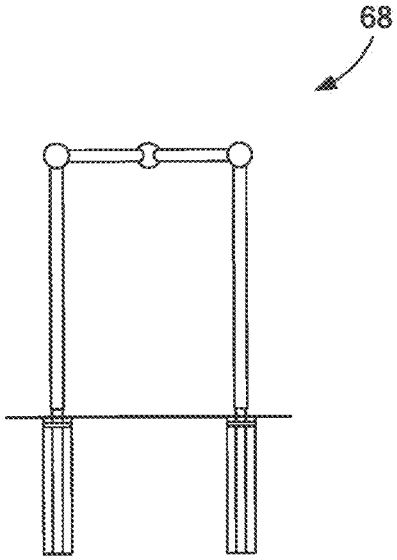

In designing an antenna for use as an array element, mutual coupling between different elements (as opposed to cross coupling among different inputs of the same element) must be accounted for. As previously stated, the antenna shown in FIGS. 3 and 4 is isolated; there is no mutual coupling between different antennas, so it cannot be expected to function as desired if inserted into an array as is. FIGS. 9 and 10 illustrate an element designed specifically as an array element.

Referring now to FIGS. 9 and 10, an array element is provided from a pair of loops having four input ports. In the exemplary embodiment of FIGS. 9 and 10, four input ports lie on a circle of radius 3.78 inches. The center conductor of each coaxial feed line is rigidly attached to a vertical post having a diameter of 0.375 inches and length 7.18 inches. Each of the four vertical posts is capped by a spherical ball of diameter 0.75 inches. Also connected to each ball is a horizontal cylindrical rod having the same diameter as the vertical posts. The horizontal rods extend towards the center of the circle on which the four input ports lie, and are joined in the center by a fifth spherical ball of diameter 0.75 inches. The spherical balls serve as connectors between the vertical posts and the horizontal rods.

Figure 11:
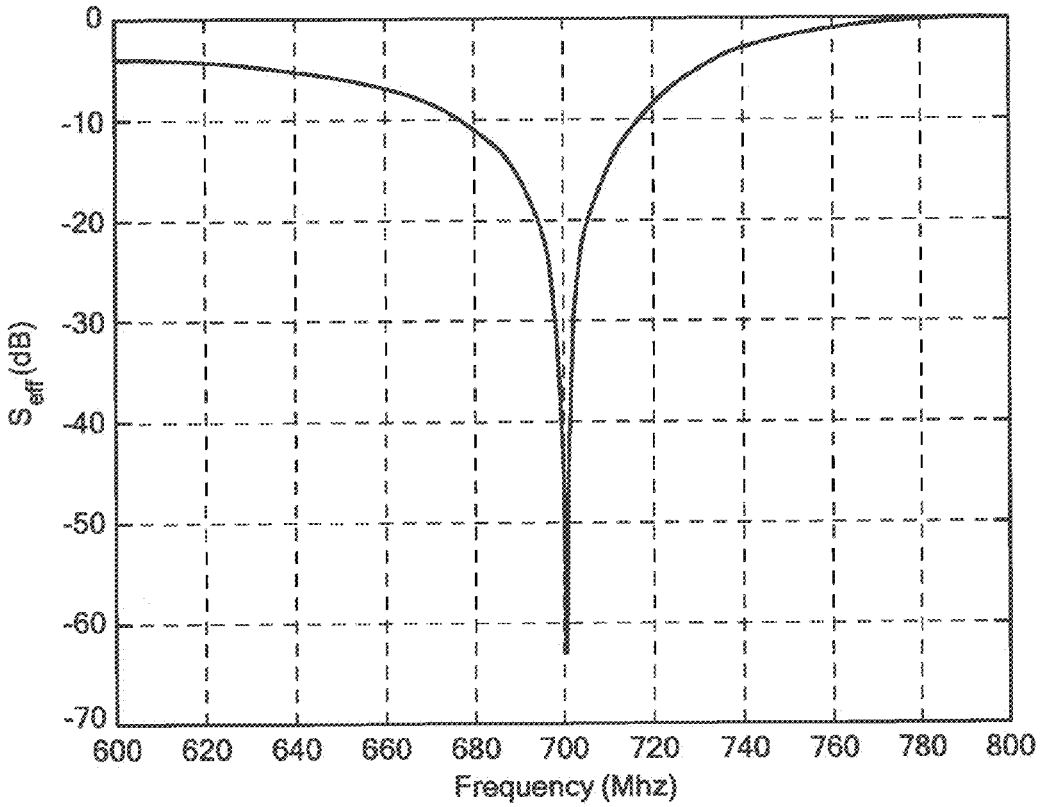
FIG. 11 is a plot of calculated effective reflection coefficient at each of the four inputs of the four-input array element shown in FIGS. 9 and 10.

Predicted performance for the four-port array element shown in FIGS. 9 and 10 is illustrated in FIGS. 11 and 13. To account for mutual coupling between different array elements, the antenna is modeled as an element in an infinite array. FIG. 11 is a plot of the effective reflection coefficient at each input port as a function of frequency when the antenna is a part of an infinite array in which the elements are separated by one-half wavelength at 700 MHz ($\lambda$=16.86" at 700 MHz). The element has a bandwidth over which $S_{eff}\leq-10$ dB of approximately 40 MHz, or 5.7%. As was the case with the isolated antenna element, the reflection coefficient will be the same whether the inputs are phased for circularly or linearly polarized radiation when the main beam is steered in the broadside direction.

Figure 12:
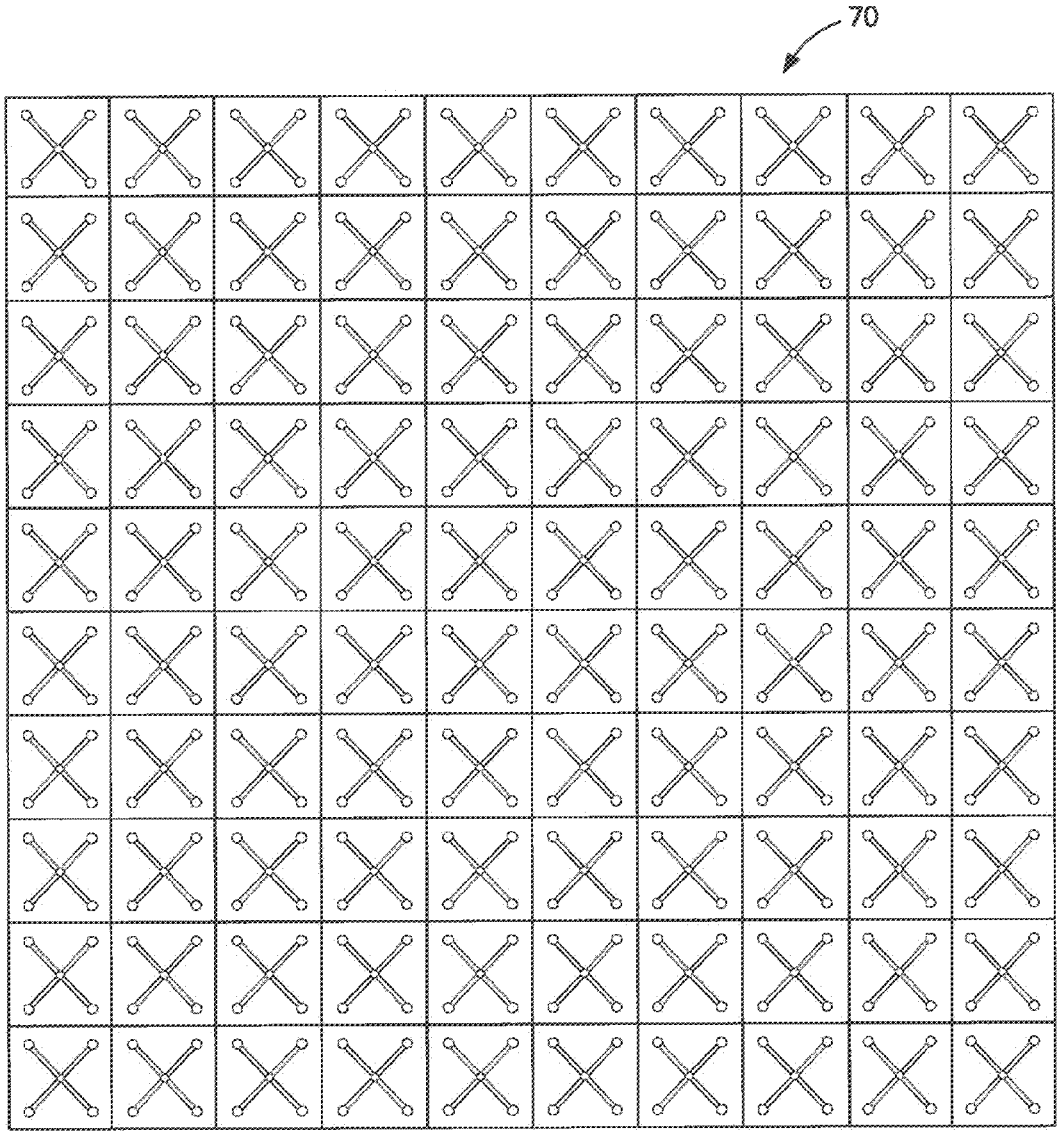
FIG. 12 is a top view of a 10 by 10 array antenna utilizing the array element illustrated in FIGS. 9 and 10.
Figure 20:
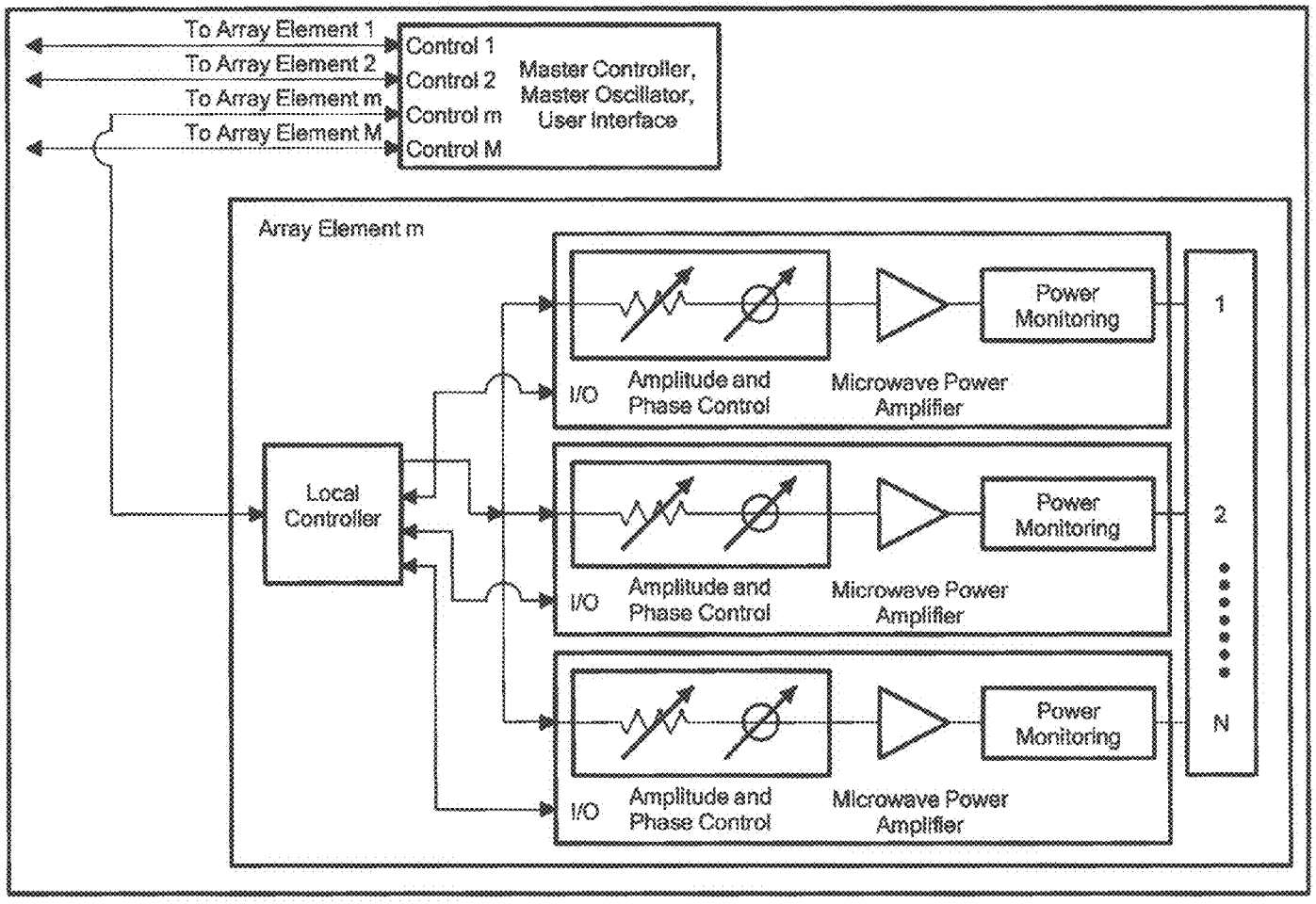
FIG. 20 is a block diagram of an element of an active electronically scanned phased array utilizing an N-input embodiment of a multiple input loop antenna element.

Described herein below in conjunction with at least FIGS. 12 and 20 is an array antenna.

It should be appreciated that in describing an array antenna reference is sometimes made herein to an array antenna having a particular number of antenna elements (e.g. a 10×10 array antenna comprised of 100 antenna elements). It should of course, be appreciated that an array antenna provided in accordance with the concepts described herein may be comprised of any number of elements and that one of ordinary skill in the art will appreciate how to select the particular number of elements to use in any particular application.

It should also be noted that reference is sometimes made herein to an array antenna having a particular array shape and/or physical size. One of ordinary skill in the art will appreciate that the techniques described herein are applicable to various sizes and shapes of panels and/or array antennas and that any number of antenna elements may be used.

Similarly, reference is sometimes made herein to sub-arrays having a particular geometric shape (e.g. square, rectangular, round) and/or size (e.g., a particular number of antenna elements) or a particular lattice type or spacing of antenna elements. One of ordinary skill in the art will appreciate that the techniques described herein are applicable to various sizes and shapes of array antennas as well as to various sizes and shapes of panels (or tiles) and/or panel sub-arrays (or tile sub-arrays).

Thus, although the description provided herein below describes the Inventive concepts in the context of an array antenna having a substantially square or rectangular shape (and possibly comprised of a plurality of tile sub-arrays each also having a substantially square or rectangular-shape), those of ordinary skill in the art will appreciate that the concepts equally apply to other sizes and shapes of array antennas and panels (or tile sub-arrays) having a variety of different sizes, shapes, and types of antenna elements. Also, the elements (as well as panels or tiles, if applicable) may be arranged in a variety of different lattice arrangements including, but not limited to, periodic lattice arrangements or configurations (e.g. rectangular, circular, equilateral or isosceles triangular and spiral configurations) as well as non-periodic or other geometric arrangements including arbitrarily shaped array geometries.

Reference is also sometimes made herein to the array antenna including an antenna element of a particular type, size and/or shape. For example, an antenna element having a size compatible with operation at a particular frequency (e.g. 10 GHz) or range of frequencies (e.g. the X-band frequency range). Those of ordinary skill in the art will recognize, of course, that the antenna elements described herein may be provided having a size selected for operation at any frequency in the RF frequency range (e.g. any frequency in the range of about 1 GHz to about 100 GHz).

Applications of at least some embodiments of the array antenna architectures described herein include, but are not limited to, radar, electronic warfare (EW) and communication systems for a wide variety of applications including ship based, airborne, missile and satellite applications. Furthermore, at least some embodiments of the antenna element and antenna array described herein are applicable, but not limited to, military, airborne, shipborne, communications, unmanned aerial vehicles (UAV) and/or commercial wireless applications.

Turning now to FIG. 12, a 10×10 array antenna having a plurality of elements is shown. Each of the elements may be the same as or similar to the type described above in conjunction with FIGS. 1-11. In one particular embodiment, the array antenna is provided from array elements shown in FIGS. 9 and 10.

Circularly and linearly-polarized broadside directivity patterns for the 10×10 array 70 shown in FIG. 12 are illustrated in FIG. 13. Neighboring elements are separated by $\lambda/2$=8.43" in both transverse dimensions. It should be noted that the input port enumeration is the same as that for the isolated antenna element shown in FIGS. 3 and 4. All patterns exhibit a dominant main lobe in the broadside direction, indicating that cross-polarized radiation does not add coherently in off-broadside directions in an array as it does in some cases for an isolated antenna. FIG. 13A is the total far-field directivity pattern, which is the same whether the inputs are phased for linear or circular polarization.

Figure 13A:
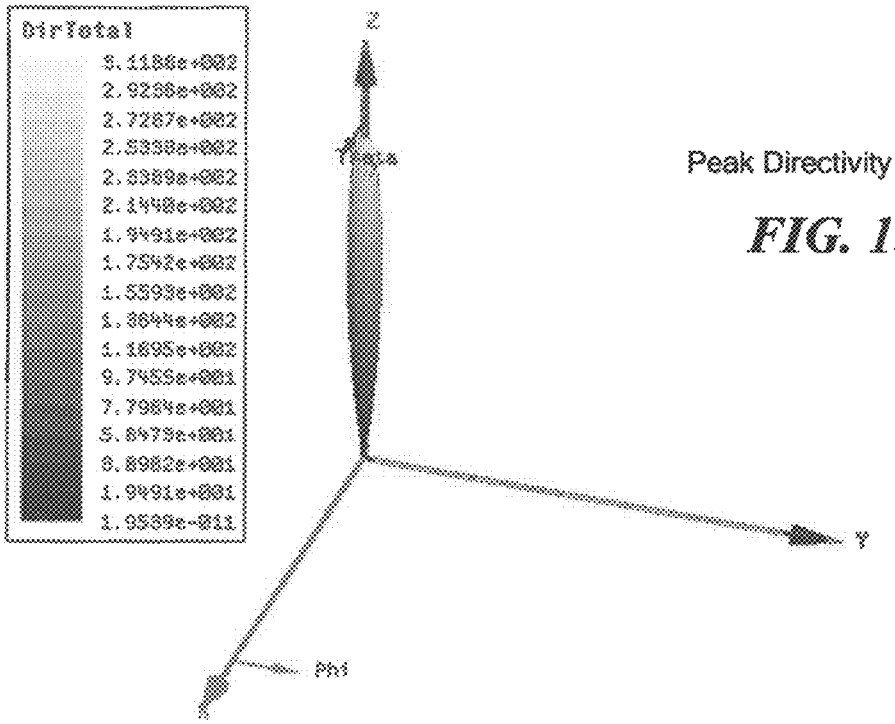
FIGS. 13A-13E are a series of calculated three-dimensional directivity patterns for the finite array illustrated in FIG. 12 when the input phases are set to generate right-hand circularly-polarized radiation (FIGS. 13 A, B, C) or linear polarization parallel to the y-axis (FIGS. 13 A, D, E).
Figure 13B:
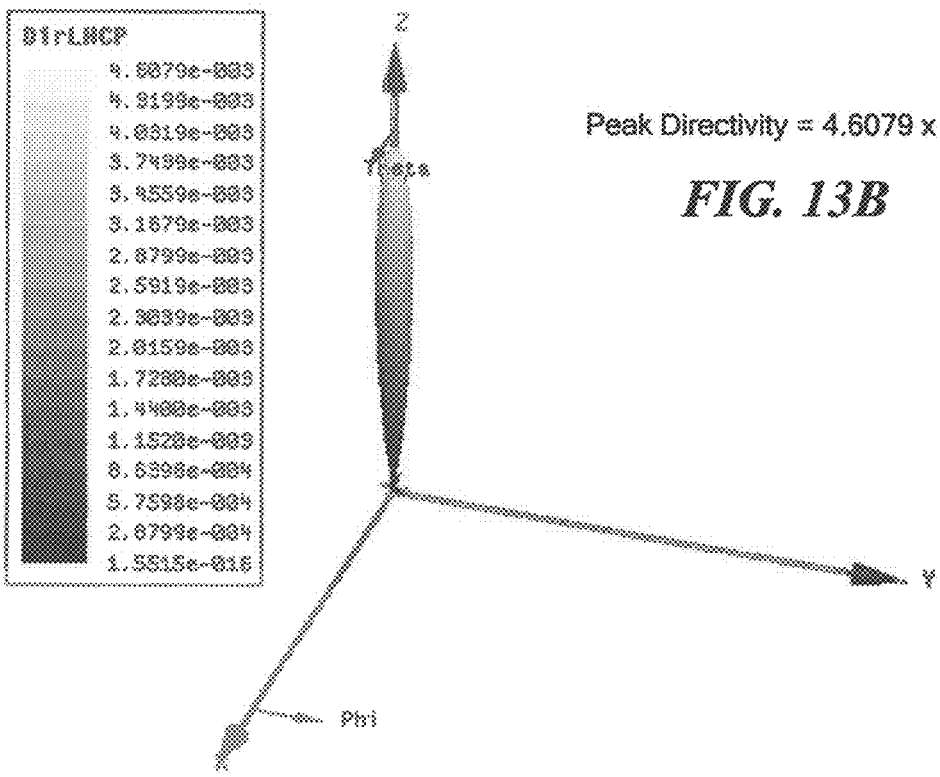
Figure 13C:
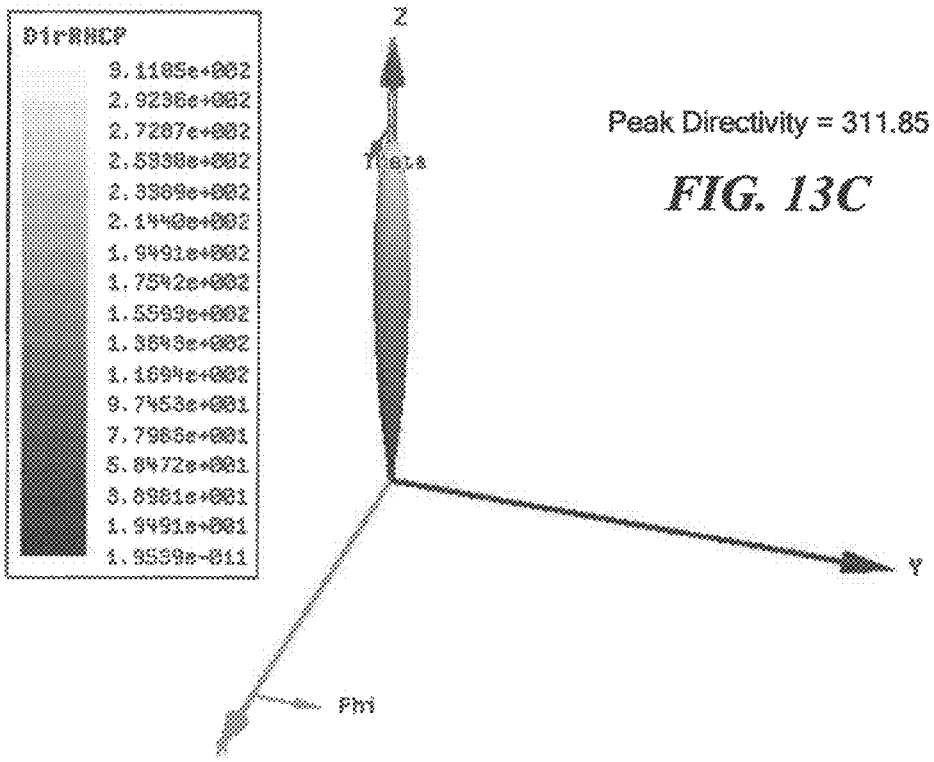
Figure 13D:
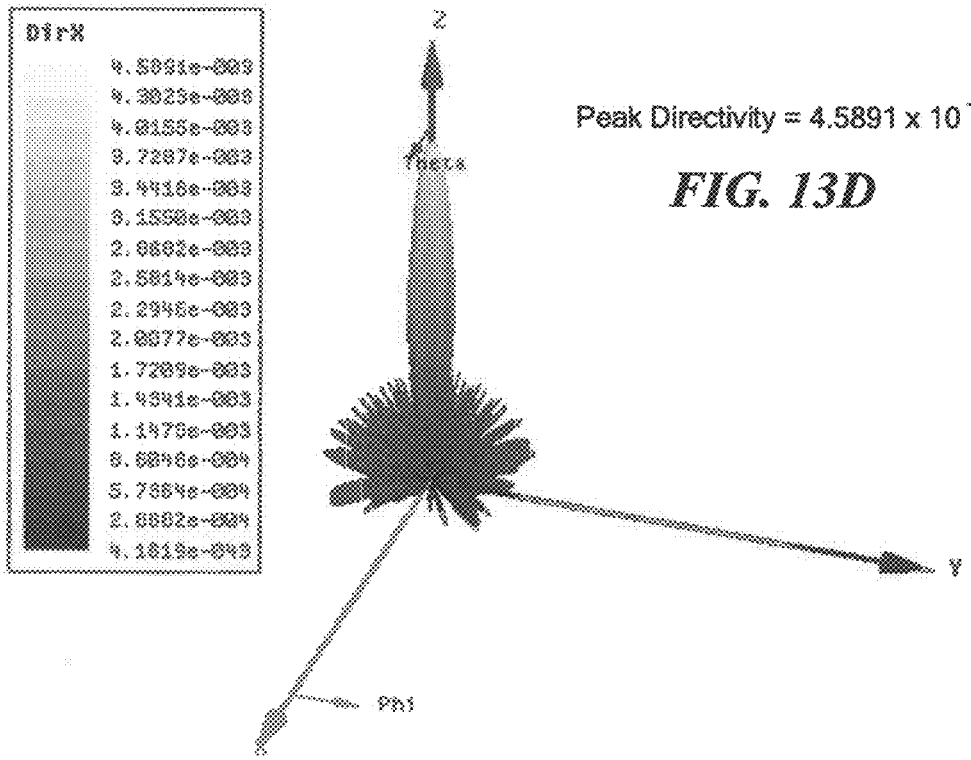
Figure 13E:
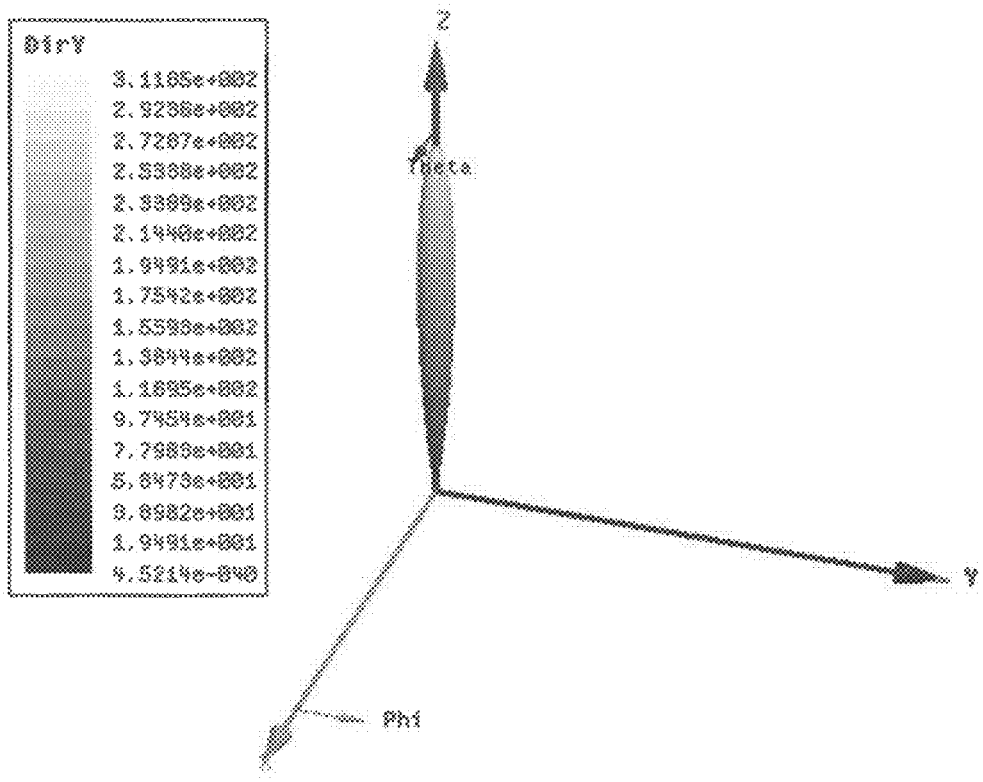

The directivity patterns when the inputs are phased for circular polarization are shown in FIGS. 13B and 13C. FIG. 13B shows the cross-polarized (RHCP) directivity pattern, and FIG. 13C the co-polarized (LHCP) directivity pattern. It is clear that the cross-polarized component is far lower than the co-polarized component, in this case by a factor of approximately 48 dB. A similar result holds for the linearly-polarized directivity patterns shown in FIGS. 13D and 13E.

Figure 14:
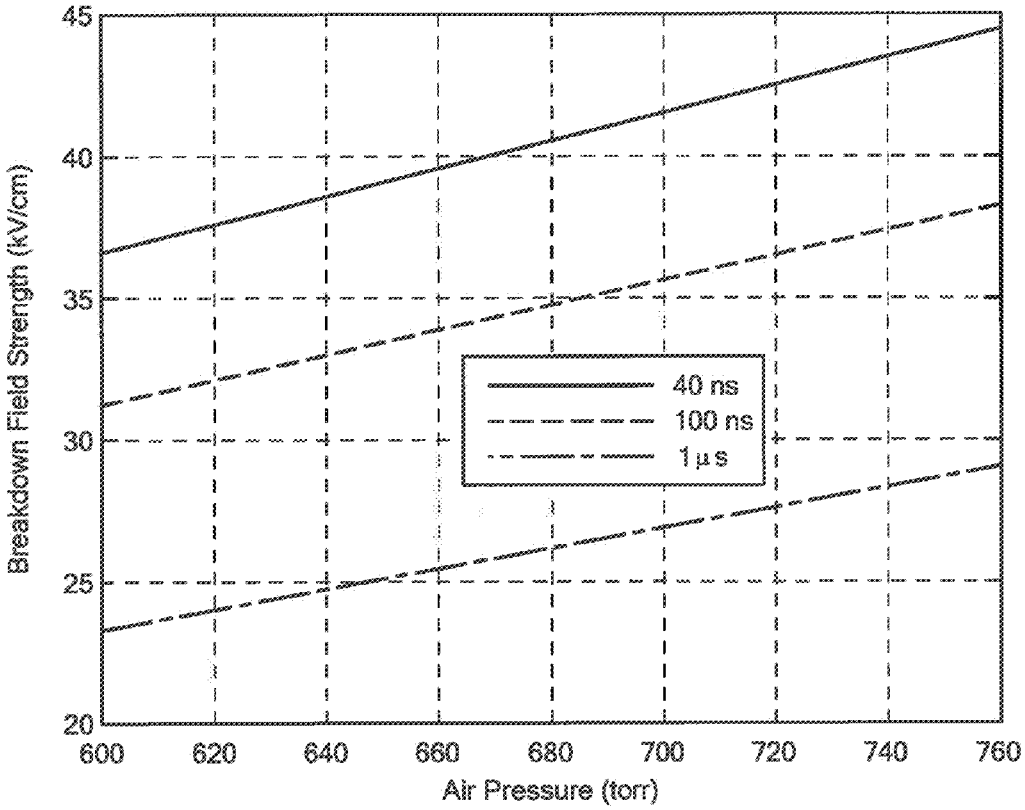
FIG. 14 is a plot of the electric field strength at the single-pulse air breakdown limit as a function of air pressure at a frequency of 700 MHz.

The peak power radiation capability of any antenna operating in air is ultimately determined by the air breakdown limit, i.e., the electric field strength at which electromagnetic fields begin to dissociate the air surrounding the antenna. The onset of air breakdown produces plasma whose effective permittivity and conductivity interfere with efficient antenna operation. Using a model as set forth in "Generalized Criteria for Microwave Breakdown in Air-Filled Waveguides" by Anderson, Lisak, and Lewin (J. Appl. Phys. 65 (8), Apr. 15, 1989) for single-pulse breakdown, the air-breakdown limit is calculated and plotted as a function of air pressure at a frequency of 700 MHz in FIG. 14. The inverse relationship between air breakdown limit and pulse length is clearly evident, which is advantageous when it is desired to radiate short pulses at high peak power levels.

Figure 15:
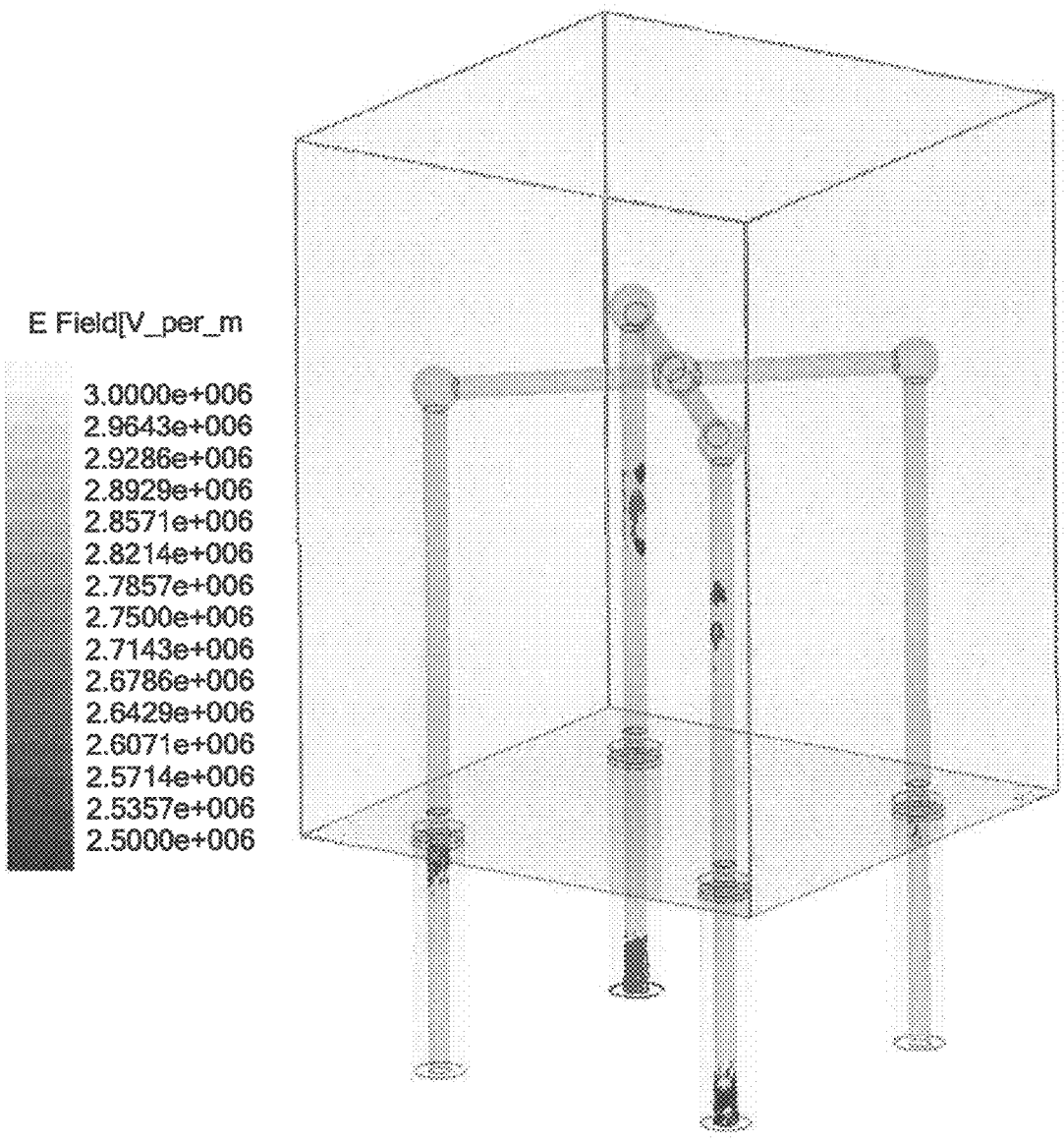
FIG. 15 is a three-dimensional field plot of the calculated electric field on and around the array element shown in FIGS. 9 and 10 when each input is driven at a power level of one (1) megawatt (MW).

FIG. 15 illustrates the high-power radiation capabilities of the array element. The calculated magnitude of the electric field is plotted for values exceeding 25 kV/cm when each input is driven at a power level of 1 MW with phases set for LHCP radiation. While field strengths of 25 kV/cm and higher are excessive at pulse lengths of 1 μs and longer, FIG. 14 suggests that such levels may be acceptable for pulse lengths on the order of 40-100 ns. FIG. 15 shows that the regions of high electric field are confined to the surface of the antenna and the immediately surrounding volume. There are no high field regions in free space in front of the aperture in which plasma created by air breakdown can reflect radiated power towards the antenna.

FIG. 15 assumes 1 MW of incident microwave power at each input, for a total of 4 MW. Given the air-breakdown limits depicted in FIG. 14 for different pulse lengths, an input power of 4 MW may be acceptable for a pulse length of 40 ns. Modifications to the antenna design are necessary if a combination of higher input power and longer pulse length is required. For example, one possible modification is to increase the conductor diameter from which the loops are constructed. Other modifications are also possible. For example, as is described herein below, pressurization with a breakdown-inhibiting gas including, but not limited to $SF_6$, is possible. Other possibilities are exemplified in one design which has been examined and which combines the following modifications to increase power handling capacity:

1. increased center conductor diameter to spread current over a greater surface, reducing peak electric field levels
2. rounded corners where the center conductor emerges through the ground plane to prevent electric field enhancement which occurs at sharp edges
3. the center conductors of each feed are capped with cylindrical pills having hemispherical end caps on top and bottom. This spreads the current over a greater surface area, further reducing peak electric field levels.

A four input loop antenna using the above modifications/techniques is described herein below in conjunction with FIGS. 21-24. It should be noted that the total radiated power is 40 MW, yet the peak electric field is comparable to that of the four input loop antenna shown in FIG. 19 for which the total input power is 20 MW.

Figure 16:
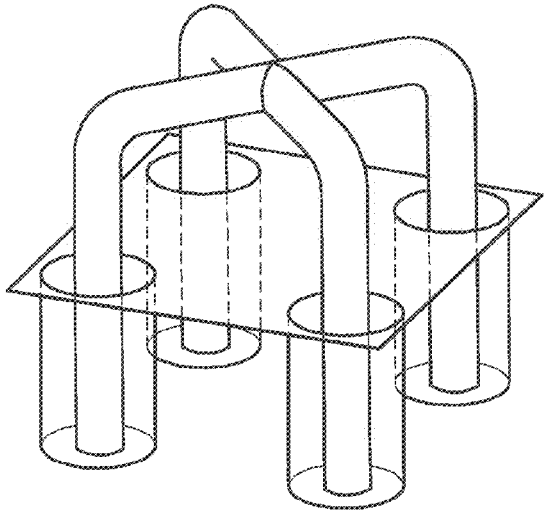
FIG. 16 is a perspective view of a four-input loop antenna designed specifically as a phased-array element and having 50Ω coaxial feed lines whose inner conductor has a diameter of one inch (1").
Figure 17A:
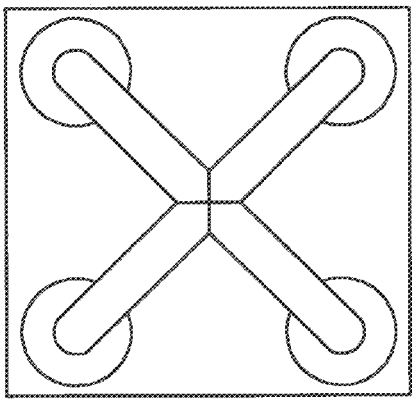
FIGS. 17A and 17B are top and side views, respectively, of the four-input array element shown in FIG. 16.
Figure 17B:
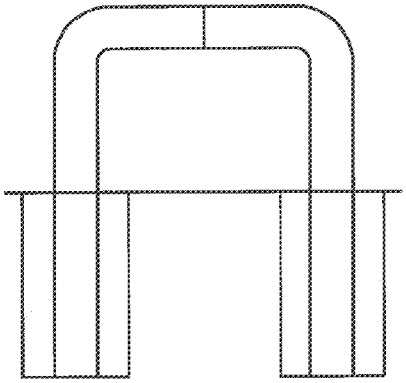

The array element shown in FIGS. 16 and 17 uses 1" diameter wire for the center conductors of the feeding transmission lines and for the loops themselves. The center conductors of the feeding transmission lines are arranged on a circle of radius 3.97 inches. The inner diameter of the outer conductors is 2.3", which yields a characteristic impedance of 50Ω when the insulating dielectric is air. The antenna itself consists of four vertical posts extending 2.62" above the ground plane, at which point the vertical posts transition to a circular 90° bend of radius 0.963". The ends of opposing circular bends are joined by horizontal rods of length 6.01"; the two intersecting horizontal rods are joined in the center. The unit cell has transverse dimensions 8.43", which is one-half wavelength at a frequency of 700 MHz.

Figure 18:
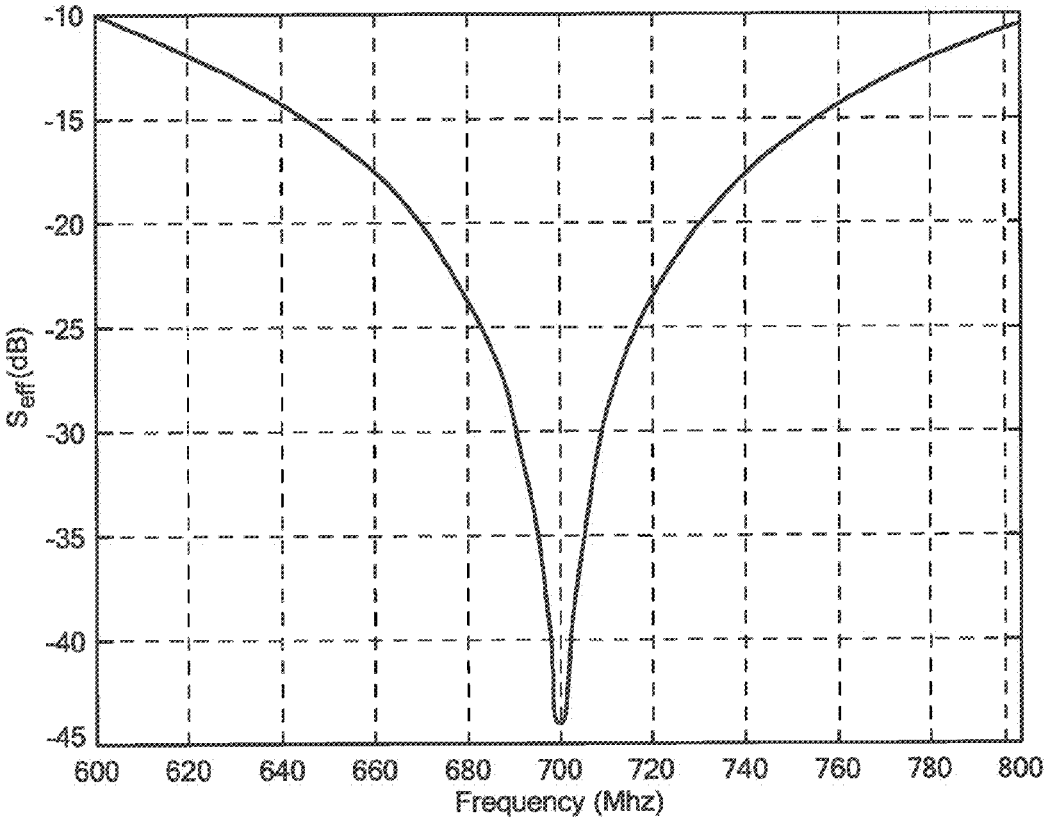
FIG. 18 is a plot of calculated effective reflection coefficient at each of the four inputs of the four-input array element shown in FIGS. 16 and 17.
Figure 19:
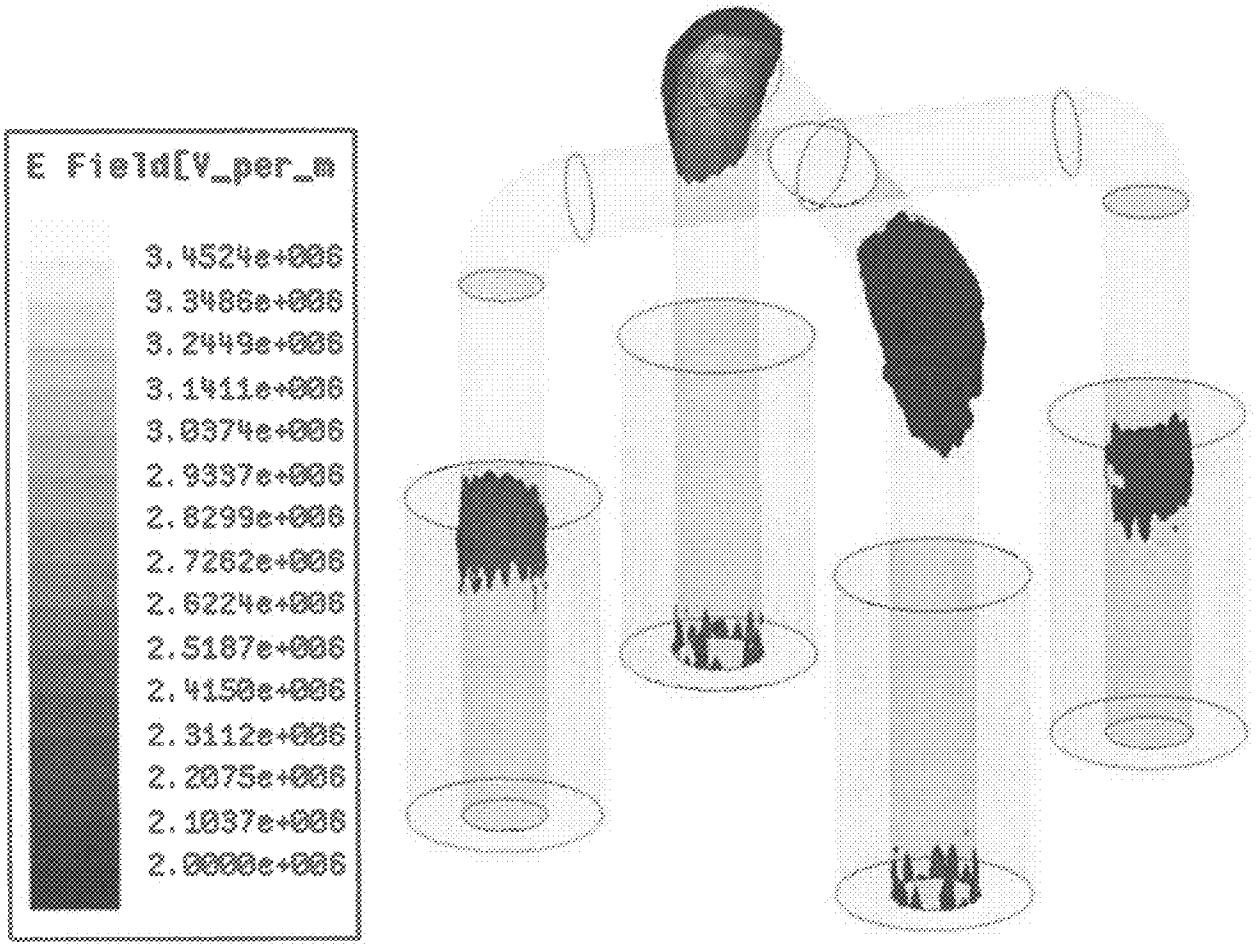
FIG. 19 is a three-dimensional field plot of the calculated electric field on and around the array element shown in FIGS. 16 and 17 when each input is driven at a power level of 5 MW.

The calculated performance of the four-input array element depicted in FIGS. 16 and 17 is displayed in FIGS. 18 and 19. The array element is modeled as an element in an infinite array.

Referring now to FIG. 18 the effective reflection coefficient at each of the four inputs for either linear or circular polarization is shown. The element has a bandwidth over which $S_{eff} \leq -10$ dB of more than 200 MHz, or 28.6%.

Referring now to FIG. 19 the capability of the antenna depicted in FIGS. 15 and 16 to radiate high power levels is shown. FIG. 19 shows the magnitude of the electric field when each input is driven at a power level of 5 MW, or a total RF input power of 20 MW. The peak electric field values visible in FIG. 19 at a 20 MW input power level are comparable to those seen in FIG. 15 at a 4 MW input power level.

FIGS. 18 and 19 illustrate several benefits derived from utilizing a larger conductor diameter. One benefit is a lower profile, as the antenna height above the ground plane is reduced from 7.37" for the array element illustrated in FIGS. 9 and 10 to 4.08" for the array element shown in FIGS. 16 and 17. A second benefit is a large increase in bandwidth, from 5.7% to 28.6%. A third benefit is greatly increased power handling capability.

The array element illustrated in FIGS. 16 and 17 derives its increased power-handling capability by its use of larger diameter conductors for the center conductors of the transmission lines and for the antenna itself. Other approaches may be used instead of or in addition to the approach described here. For example, all or part of the radiating structure may be encased in an insulating dielectric having a high dielectric strength. Regions of high peak electric fields may be mitigated through judicious use of insulating dielectric to isolate such regions from air so that breakdown cannot occur. A variant of this approach is to enclose the antenna within a vessel and to fill the interior with an insulating gas having a high dielectric strength such as $SF_8$. Those skilled in the art will appreciate that other means may be used to mitigate regions of excessive peak electric field values without departing from the scope of the present invention.

While only two- and four-input embodiments of the present invention have been disclosed herein, those skilled in the art will appreciate that the invention is not so limited. Only geometric constraints limit the number of inputs for a single antenna. Furthermore, the number of inputs is not constrained to be a power of two.

Referring now to FIG. 20 an element of an active electronically scanned phased array utilizing an N-input embodiment of the present invention. A central control unit provides an interface between a user and the array, distributes RF from a master oscillator to each array element, and generates and distributes control signals to each array element. A two-way interface is provided between the central controller and each array element. Said two-way interface provides a pathway for the distribution of signals from the central controller to each array element. Said two-way interface further provides a pathway for return signals from each array element to the central controller. Such return signals may carry information about the state of each array element, for example. Signals distributed by the central controller to each array element determine the direction of the main beam, beam polarization (e.g., RHCP, LHCP, vertical linear or horizontal linear), and radiated power level. Those skilled in the art will appreciate that the central controller may exercise control over additional properties of the array without departing from the scope of the present invention.

A local controller resides within each element of the array. Said local controller receives and processes signals from the central controller, and distributes processed signals to functional elements within each of N microwave power amplifier modules residing within each array element. Within said array element, each microwave power amplifier module delivers its output to one input of an N-input loop antenna. Functional elements comprising each microwave power amplifier module may include but is not limited to amplitude and phase control, a microwave power amplifier, and power monitoring. Based on instructions received from the local controller, the amplitude and phase control functional unit exercises control over the amplitude and phase of the microwave signal prior to amplification by the microwave power amplifier. The microwave power amplifier amplifies the input signal to a desired output level prior to radiation by the antenna. The power monitoring functional unit monitors the output power from the power amplifier, and relays this information to the central controller via the local controller. This information may be used by the central controller to monitor the health of each array element. For example, if the performance of a given array element falls below a first set of thresholds, the central controller can instruct the corresponding local controller to modify drive voltages and/or currents of the power amplifier to restore the desired level of performance. Furthermore, if the performance of said array element falls below a second set of thresholds, the central controller can advise the user that performance of said array element falls below minimum standards and requires replacement. Those skilled in the art will appreciate that additional functional units may be added without departing from the scope of the present invention.

Figure 21A:
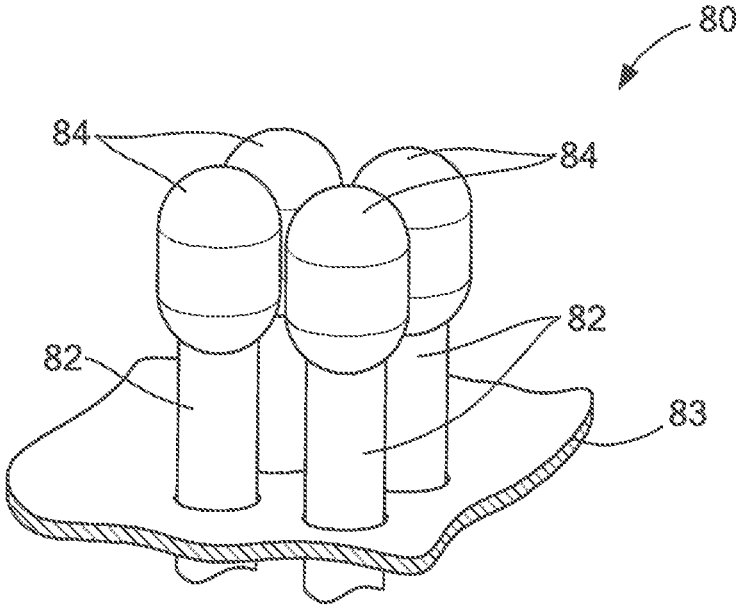
FIG. 21A is a perspective view of a high power four-input antenna array element.
Figure 21C:
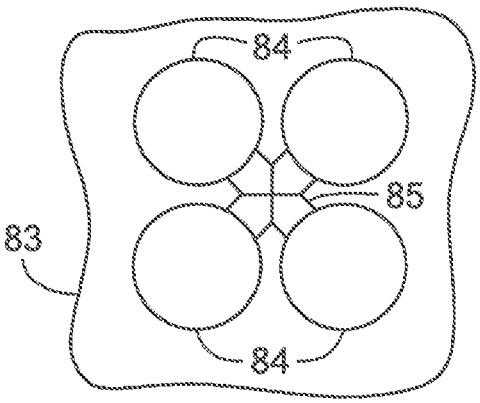
FIGS. 21B and 21C are respective top and side views of the f high power four-input antenna array element shown in FIG. 21.
Figure 21B:
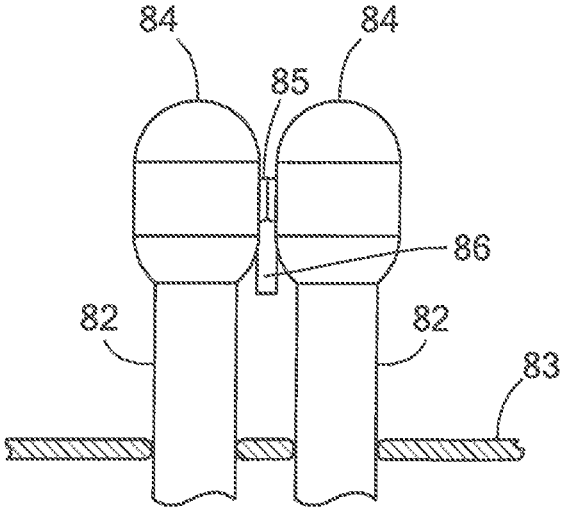

Referring now to FIGS. 21-21B in which like elements are provided having like reference designations throughout the several views, an array element 80 having very high power capability is shown. In this exemplary embodiment, the feeding transmission lines 82 are provided as coaxial lines having outer conductors with diameters of 2.79" and having inner conductors (not visible) with diameters of 2". This geometry yields a characteristic impedance of 20Ω when the insulating dielectric is air. The center conductors of the feeding transmission lines are arranged on a circle of radius 2.38 inches. In the exemplary embodiment of FIG. 21, the conductors are equally spaced. To reduce (or, in some cases, prevent) edge (or field) enhancement, the junction at which the outer conductor of each feeding transmission line 82 meets ground plane 83 is rounded. This is most clearly visible in FIG. 21B. In one exemplary embodiment, the edge of the ground plane opening is provided having a radius of 0.5". A cap 84, here illustrated as a pill-shaped cap 84, is affixed or otherwise coupled to the end of the center conductor of each feeding transmission line 82.

The purpose of caps 84 is to reduce the peak electric field on the antenna surface. In this exemplary embodiment, each cap 84 is provided from a cylindrical section 1.75" in length and 3" in diameter capped by hemispheres of the same diameter. Each pill-shaped cap is offset from the ground plane so that its midpoint lies 1.728" above the ground plane. At this point, diagonally opposite pill-shaped caps are joined otherwise coupled by joining sections 85, illustrated as horizontal 1" diameter rods in FIGS. 21-21B. Since the transmission lines feeding diagonally opposite inputs are 180 degrees out of phase, the midpoint of the corresponding horizontal rod is a virtual ground; this point can be physically connected to the ground plane without impacting the RF performance of the antenna. As most clearly illustrated in FIG. 21B, a vertical grounding rod 86 (FIG. 21B) can be used to join to the midpoint of the horizontal rods to the ground plane in order to provide a return path to ground for any direct current components that might be present in the input signals.

Figure 22:
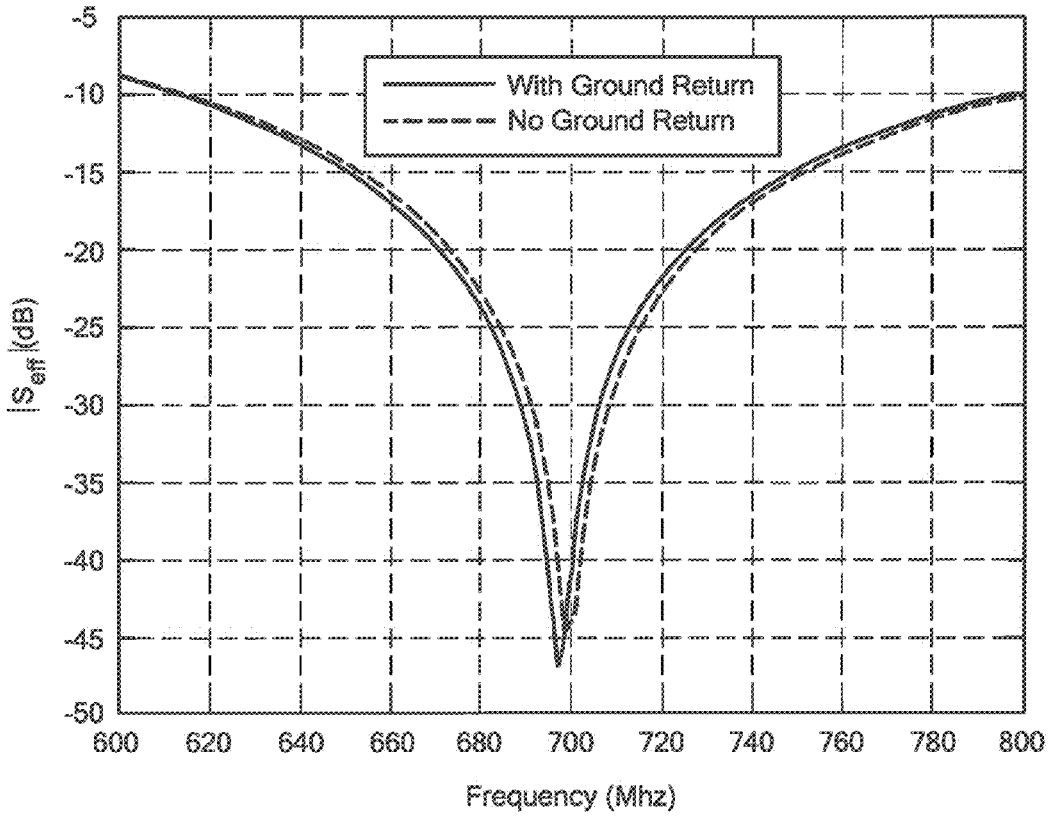
FIG. 22 is a plot of effective reflection coefficient at each of the four inputs for either linear or circular polarization for the antenna shown in FIGS. 21A-21C.
Figure 23:
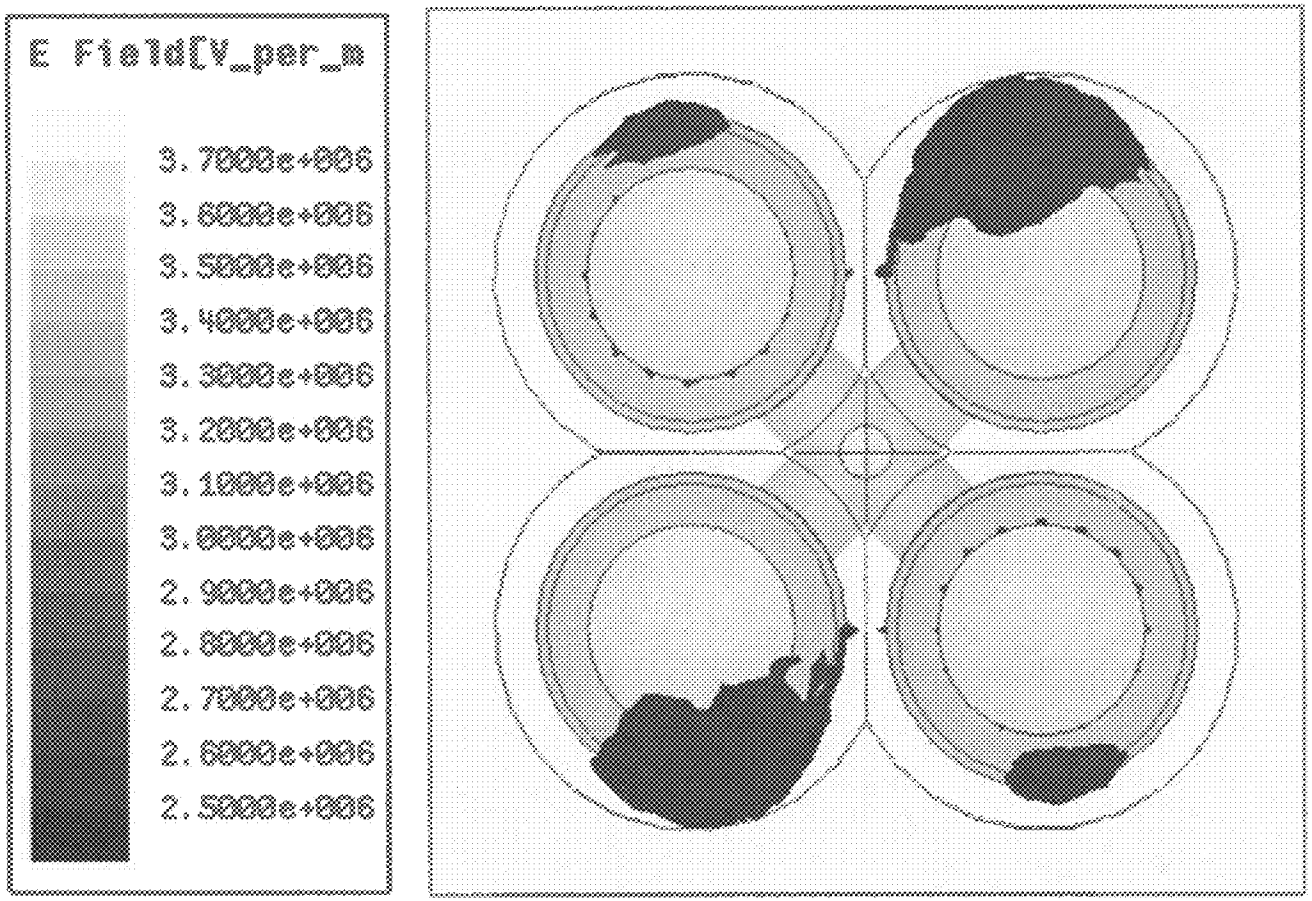
FIG. 23 is a three-dimensional field plot of the electric field magnitude on and around the array element shown in FIGS. 21A-21C when each input is driven at a power level of 10 MW.
Figure 24:
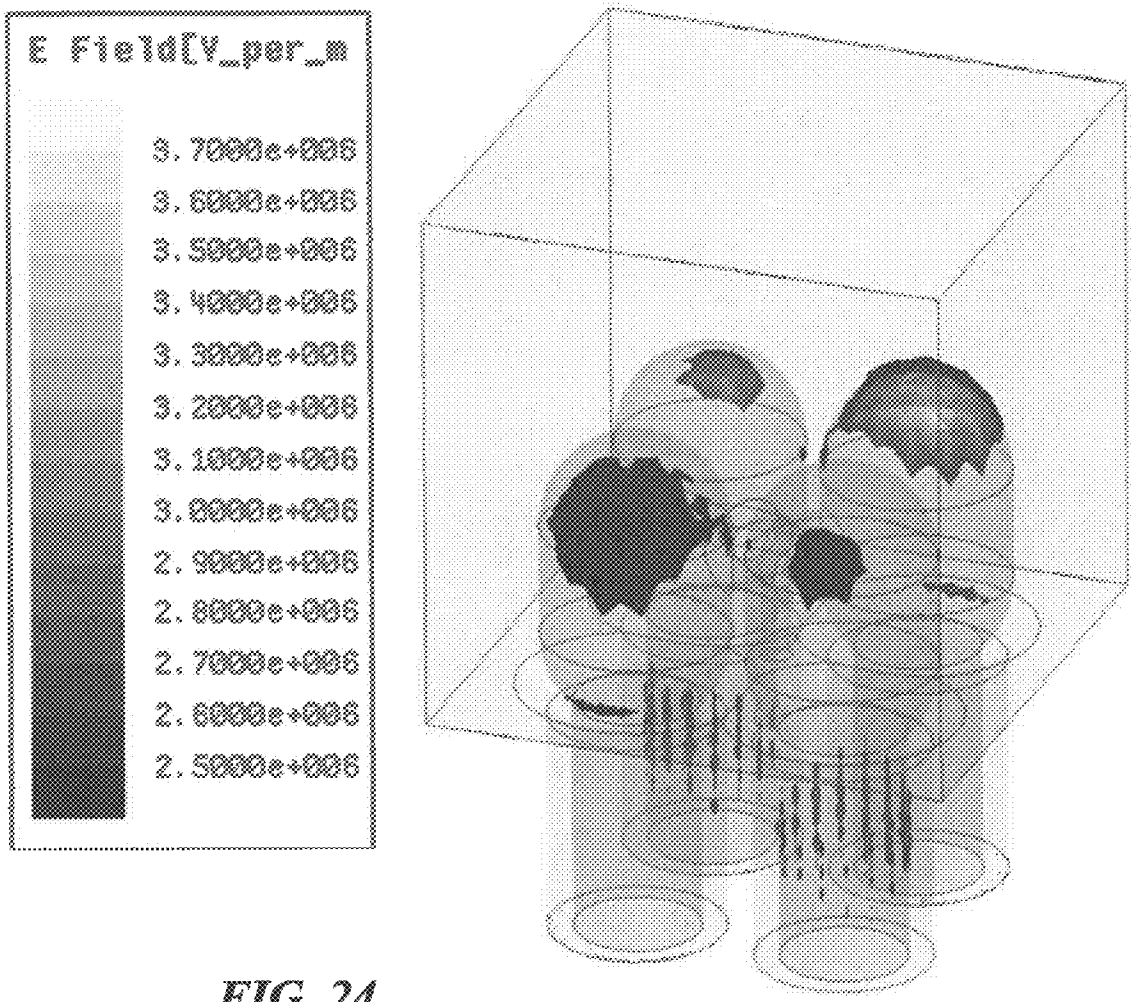
FIG. 24 is a top view of the three-dimensional field plot of the FIG. 23.

Referring now to FIGS. 22-24, calculated performance of the array in FIGS. 22-21B is displayed. For purposes of the calculate performance, the array element illustrated in FIG. 21 is modeled as a single element in an infinite array.

In FIG. 22, the effective reflection coefficient at each of the four inputs for either linear or circular polarization is shown. Data is plotted for array elements with and without a grounding rod. In either case, the element has a bandwidth over which $S_{eff} \leq -10$ dB of 185 MHz, or 26%.

FIGS. 23 and 24 illustrate the high power capability of the array element. FIGS. 23 and 24 show the magnitude of the electric field when each input is driven at a power level of 10 MW, or a total RF input power of 40 MW. The peak electric field values are comparable to those seen in FIG. 15 at a 4 MW input power level and in FIG. 19 at a 20 MW input power level.

Having described preferred embodiments which serve to illustrate various concepts, structures and techniques which are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. A multiple input loop antenna comprising:

a ground plane;

one or more half-loop antennas disposed above said ground plane wherein the plane of each half loop is perpendicular to said ground plane, each of said one or more half-loop antennas having first and second input ports;

one-half of a circular loop; and a pair of vertical posts disposed through said ground plane and upon which said one-half of a circular loop is disposed and wherein the height of said vertical posts and the horizontal separation between said vertical posts are selected to match an impedance characteristic at the first and second input ports.

2. The multiple input loop antenna of claim 1 wherein each of said plurality of multiple input loop antenna comprises one or more coaxial transmission lines, each of said one or more coaxial transmission lines coupled to one of the first and second inputs of a respective one of said one or more half-loop antennas.

3. The multiple input loop antenna of claim 2 wherein input signals feeding opposite ends of each half-loop antenna are of substantially equal amplitudes and are 180° out of phase.

4. The multiple input loop antenna of claim 1 comprising at least two of said half-loop antennas with said at least two of said half-loop antenna coupled at a common point where said half-loop antennas converge.

5. A multiple input loop antenna comprising:

N half-loop antennas disposed above a ground plane wherein the plane of each of said N half-loop antennas is perpendicular to said ground plane and wherein each of said N half-loop antennas have a first and second input ports to provide the multiple input loop antenna having 2N input ports with each input coupled to a respective one of 2N vertical posts disposed through said ground plane and wherein the heights of said vertical posts and the horizontal separation between said vertical posts are selected to match an impedance characteristic at the 2N input ports.

6. A four-input antenna comprising:

a ground plane; and a pair of half-loop antennas disposed over said ground plane, each of said pair of half-loop antennas have a first and second input ports, wherein the plane of each half-loop antenna is perpendicular to said ground plane such that the pair of half-loop antenna are adapted to combine the outputs from four separate RF sources and are adapted to radiate at least one of linear or circular polarization, depending upon the relative phases of the signals driving each of the half-loops wherein the heights of said half loop antennas above the ground plane and the horizontal separation between said pair of half loop antennas are selected to match an impedance characteristic at the input ports.

7. The four-input antenna of claim 6 further comprising means for shifting the phases of the input signals to dynamically change the polarization of signals to which the four input antenna is responsive.

8. The four-input antenna of claim 7 further comprising a waveguide and wherein said ground plane and said pair of half-loops are disposed within said waveguide to launch waves within said waveguide and wherein said pair of half-loops are disposed at an insertion point within said waveguide selected to match a magnetic field vector orientation of a radio frequency (RF) signal mode to be launched within said waveguide.

9. The four-input antenna of claim 7 further comprising a resonant cavity and wherein said ground plane and said pair of half-loops are disposed within said resonant cavity to launch waves within said resonant cavity and wherein said pair of half-loops are disposed at an insertion point within said resonant cavity selected to match a magnetic field vector orientation of a radio frequency (RF) signal mode to be launched within said waveguide.

10. An array antenna comprising:

a plurality of multiple input loop antennas, each of said multiple input loop antennas comprising:

a ground plane; and one or more half-loop antennas disposed above said ground plane, wherein the plane of each half loop is perpendicular to said ground plane and each of said pair of half-loop antennas have a first and second input ports, and wherein the heights of said one or more half loop antennas above the ground plane and the horizontal separation between said one or more half loop antennas are selected to match an impedance characteristic at each of the first and second input ports.

11. The array antenna of claim 10 wherein said half-loop antennas are coupled at a common point where the loops converge.

12. The array antenna of claim 10 wherein each of said plurality of multiple input loop antennas comprises one or more coaxial transmission lines configured to feed both ends of each loop.

13. The array antenna of claim 12 wherein input signals feeding opposite ends of each loop are of approximately equal amplitudes and are 180° out of phase.

14. The array antenna of claim 10 wherein the array antenna corresponds to an active electronically scanned phased array and further comprises:

a central control unit having a user interface and an array antenna interface wherein said central control unit distributes radio frequency (RF) signals provided from a master oscillator to each element in said array antenna, and generates and distributes control signals to each element in said array antenna.

15. The array antenna of claim 14 further comprising a two-way interface coupled between the central control unit and each array element, said two-way interface providing a pathway for the distribution of signals from said central control unit to each array element and for providing a pathway for return signals from each array element to said central control unit.

16. The array antenna of claim 15 wherein the return signals carry information about the state of each array element.

17. The array antenna of claim 14 wherein signals distributed by said central control unit to each element in said array antenna determine one or more of: a direction of a main beam; a beam polarization; and a radiated power level.

18. The array antenna of claim 14 further comprising:

a power amplifier module residing within each element; and a local controller residing within each element of the array antenna wherein said local controller receives and processes signals from said central control unit and distributes processed signals to functional elements within each of said power amplifier modules.

19. The array antenna of claim 18 wherein within each of said elements in said array antenna, each power amplifier module has an output coupled to one input of an N-input loop antenna.

20. The array antenna of claim 19 wherein each power amplifier module comprises:

an amplitude and phase control circuit;

a power amplifier; and a power monitoring circuit and wherein in response to instructions received from said local controller, the amplitude and phase control circuit exercises control over the amplitude and phase of RF signals prior to amplification by said power amplifier wherein said power amplifier amplifies the input signal to a desired output level prior to radiation by the array antenna.

21. The array antenna of claim 20 wherein said power monitoring circuit monitors power levels of signals provided by said power amplifier and relays the power level information to said central control unit via said local controller such that the power level information may be used by said central control unit to monitor each array element.

22. The array antenna of claim 21 wherein in response to performance of a given element in the array antenna falling below a first set of threshold values, said central control unit instructs the corresponding local controller to modify one or more of drive voltages and currents of said power amplifier to restore a desired level of performance.

23. The array antenna of claim 21 wherein in response to performance of an element in said array antenna falling below a second set of threshold values, said central control unit provides an alert that performance of said array element falls below a desired standard.

* * * * *